US011708141B2

(12) United States Patent
Caranto

(10) Patent No.: US 11,708,141 B2
(45) Date of Patent: Jul. 25, 2023

(54) COLLAPSIBLE PADDLE FOR WATERCRAFT

(71) Applicant: Pau Hana Surf Supply Company, Santa Clarita, CA (US)

(72) Inventor: Todd Caranto, Santa Clarita, CA (US)

(73) Assignee: Pau Hana Surf Supply Company, Santa Clarita, CA (US)

( * ) Notice: Subject to any disclaimer, the term of this patent is extended or adjusted under 35 U.S.C. 154(b) by 63 days.

(21) Appl. No.: 17/303,535

(22) Filed: Jun. 1, 2021

(65) Prior Publication Data

US 2021/0371068 A1 Dec. 2, 2021

Related U.S. Application Data

(60) Provisional application No. 63/032,870, filed on Jun. 1, 2020.

(51) Int. Cl.
*B63H 16/04* (2006.01)

(52) U.S. Cl.
CPC ..... *B63H 16/04* (2013.01); *B63H 2016/046* (2013.01)

(58) Field of Classification Search
CPC ... B63H 16/04; B63H 16/00; B63H 2016/046
See application file for complete search history.

(56) References Cited

U.S. PATENT DOCUMENTS

| | | | | |
|---|---|---|---|---|
| 1,789,749 | A * | 1/1931 | Herring | B63H 16/04 416/142 |
| 2,763,015 | A | 9/1956 | Weigand | |
| 6,022,255 | A | 2/2000 | Lukanovich | |
| 2003/0040233 | A1* | 2/2003 | Oathout | B63B 25/002 114/343 |
| 2014/0248075 | A1* | 9/2014 | Lee | F16B 7/1454 403/109.1 |

FOREIGN PATENT DOCUMENTS

| | | | |
|---|---|---|---|
| KR | 200390426 | Y1 | 7/2005 |
| WO | 2019236910 | A1 | 12/2019 |

OTHER PUBLICATIONS

Go Air Kayaks, "Shearwater Webbed Paddles—a Unique Concept", Mar. 28, 2012.
International Search Report and Written Opinion for Application No. PCT/US2021/035300, dated Sep. 2, 2021.

* cited by examiner

*Primary Examiner* — Jacob M Amick
(74) *Attorney, Agent, or Firm* — Merchant & Gould P.C.

(57) ABSTRACT

A paddle for use with watercraft can include a shaft assembly, a handle connected to a first end of the shaft assembly, and a blade assembly including a flexible blade part removably connected at a second end of the shaft assembly, the blade part being foldable when removed from the shaft assembly. In some examples, the blade part is foldable into a rolled-up position when removed from the shaft assembly.

20 Claims, 28 Drawing Sheets

COLLAPSIBLE PADDLE FOR WATERCRAFT

RELATED APPLICATION

This application claims priority to U.S. Provisional Patent application Ser. No. 63/032,870, filed on Jun. 1, 2020, the entirety of which is incorporated herein by reference.

BACKGROUND

Stand up paddle boarding has become a popular recreational and competitive activity while other paddling activities, such as canoeing have also remained popular. For stand up paddle board paddles in particular, their unique length can result in undesirable storage requirements. For example, air travel with such a paddle can be cumbersome. Additionally, such paddles are highly specific to the user and activity, thereby rendering them less able to be shared among users. As such, improvements are desired.

SUMMARY

A paddle for use with watercraft can include a shaft assembly, a handle connected to a first end of the shaft assembly, and a blade assembly including a flexible blade part removably connected at a second end of the shaft assembly, the blade part being foldable when removed from the shaft assembly.

In some examples, the blade part is foldable into a rolled-up position when removed from the shaft assembly.

In some examples, the blade part defines opposite first and second paddling surfaces and further defines a central opening between the first and second paddling surfaces, the central opening receiving the shaft assembly.

In some examples, the blade assembly further includes a support pin oriented orthogonally to the shaft assembly.

In some examples, the support pin is received into one or more second openings defined by the blade part.

In some examples, the one or more second openings are orthogonal to the central opening.

In some examples, the support pin is connected to the shaft assembly.

In some examples, the support pin is connected to the shaft assembly with a snap-fit type connection.

In some examples, the shaft assembly includes a cap part defining a groove that removably receives the support pin.

In some examples, the shaft assembly includes multiple interconnected shaft parts.

In some examples, the handle is connected to a first shaft part and wherein the first shaft part is slideable relative to a second shaft part.

In some examples, the paddle further includes a clamp for securing the first shaft part to the second shaft part.

In some examples, the blade part is formed from a flexible polyvinyl chloride (PVC) sheet material.

In some examples, the shaft assembly is formed from an aluminum, fiber glass, or carbon fiber material.

In some examples, the blade part is formed by folding a sheet material about a fold line.

In some examples, the blade part is formed by one of ultrasonic welding or adhering a first half of the blade part to a second half of the blade part.

In some examples, the paddle has an overall disassembled storage length equal to the length of the longest shaft part.

In some examples, the paddle has an overall disassembled storage length equal to about 20 inches.

In some examples, the paddle can be adjusted to have a length between 44 inches and 78 inches.

A paddle assembly can include a paddle with any of the above-described features and a storage bag for holding the paddle in a disassembled state, the storage bag having a length of generally the same length as a longest individual part of the paddle.

A variety of additional aspects will be set forth in the description that follows. These aspects can relate to individual features and to combinations of features. It is to be understood that both the foregoing general description and the following detailed description are exemplary and explanatory only and are not restrictive of the broad concepts upon which the embodiments disclosed herein are based.

DETAILED DESCRIPTION

Figure 1:
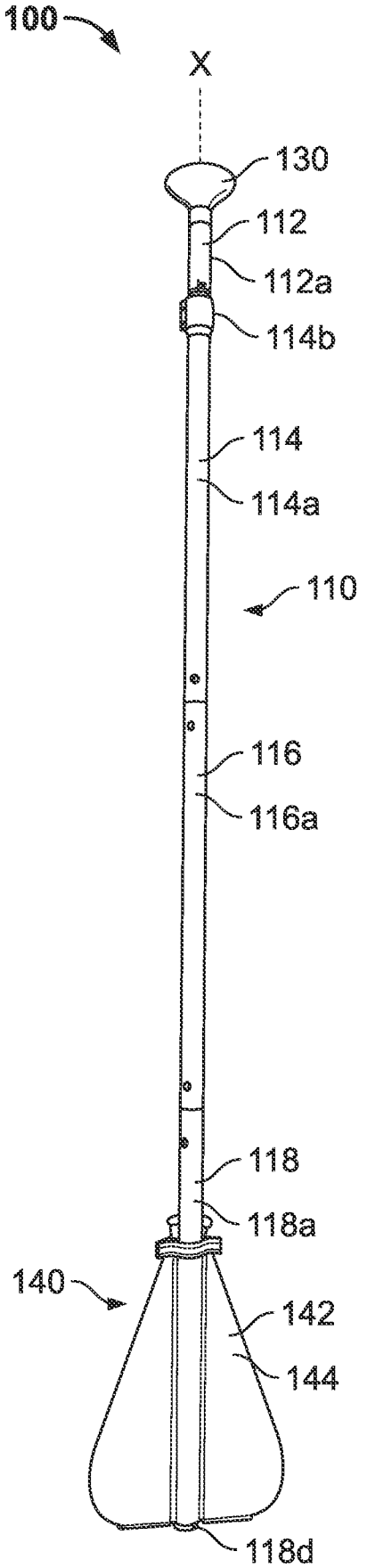
FIG. 1 is a front view of a collapsible paddle having features in accordance with the disclosure.

Various embodiments will be described in detail with reference to the drawings, wherein like reference numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

Referring to FIG. 1, a collapsible paddle 100 is presented in which the collapsible paddle 100 is shown in a first assembled configuration. In general terms, the collapsible paddle 100 includes a shaft assembly 110, a handle 130 disposed at one end of the shaft assembly 110, and a blade assembly 140 disposed at the opposite end of the shaft assembly, wherein the aforementioned components aligned along a common axis X. As is illustrated and discussed in more detail later, the collapsible paddle 100 can be configured to have different lengths and can also be disassembled into a compact storage arrangement.

In the example shown, the shaft assembly 110 of the collapsible paddle 100 includes four shaft parts 112, 114, 116, 118 and a two connector parts 120. In one aspect, the shaft part 112 includes a shaft portion 112*a*. The shaft parts can be formed from plastic, metal, or composite materials, such as carbon fiber. In some examples, the shaft parts are formed from cylindrical tubing, such as aluminum tubing as is shown, but oval and other shapes are also possible. At one end of the shaft portion 112*a*, the handle 130 is secured to the shaft portion 112*a*, for example by an adhesive and/or by mechanical fasteners. The handle 130 can be formed from a polymeric material or from another material, such as carbon fiber. In one aspect, the opposite end of the shaft portion 112*a* from the handle 130 is slidably received into a shaft portion 114*a* of the shaft part 114. As shown, the shaft part 114 is provided with a clamp 114*b* that secures the shaft portion 112*a* within the shaft portion 114*a* such that relative movement is prevented. Accordingly, a user can release the clamp 114*b* to an open or unsecured position, adjust the length of the paddle by telescoping or sliding the shaft part 112 further into or out of the shaft part 114, and then moving the clamp back into a closed or secured position. As shown, the clamp 114*b* is a cam-type lever clamp that can be operated without the use of tools. Other types of clamps and securing mechanisms can be used without departing from the concepts presented herein. In alternative embodiments, where an adjustable length paddle is not desired, the paddle 100 could be provided without the shaft part 112 and the shaft part 114 could then be provided with the handle portion.

In one aspect, the shaft part 114 is connected to the shaft part 116 by the connector part 120. In the example shown, the connector part 120 is provided with a shaft portion 120*a* having a diameter smaller than that of the shaft portions 114*a*, 116*a*, thereby allowing the shaft portion 120*a* to be slid into the shaft portions 114*a*, 116*a*. At each end of the shaft portion 120*a*, a spring clip 120*b* having a depressible button 120*c* is provided. The shaft parts 114 and 116 are respectively provided with openings 114*c*, 116*b* into which buttons 120*c* extend to secure the shaft parts 114, 116 to the connector part 120. The shaft parts can be disconnected from each other by depressing the buttons 120*c* back through the openings 114*c*, 116*c*. The shaft part 118, having a shaft portion 118*a* and opening 118*b*, is connected to the shaft part 116 by a connector part 120 in the same manner as described above.

Figure 9:
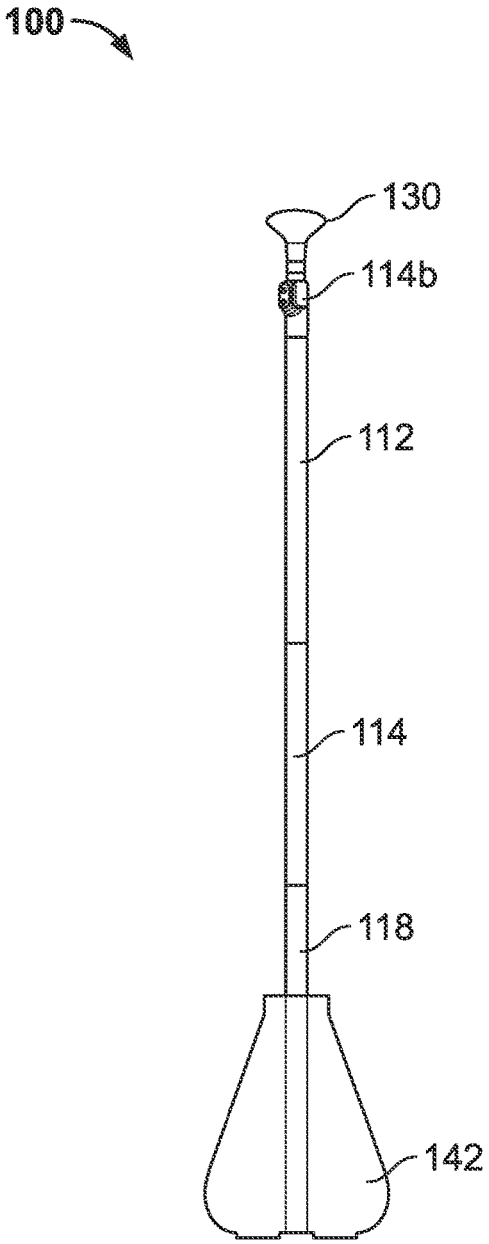
FIG. 9 is a schematic front view of the collapsible paddle shown in FIG. 8, the collapsible paddle being in a second configuration.
Figure 10:
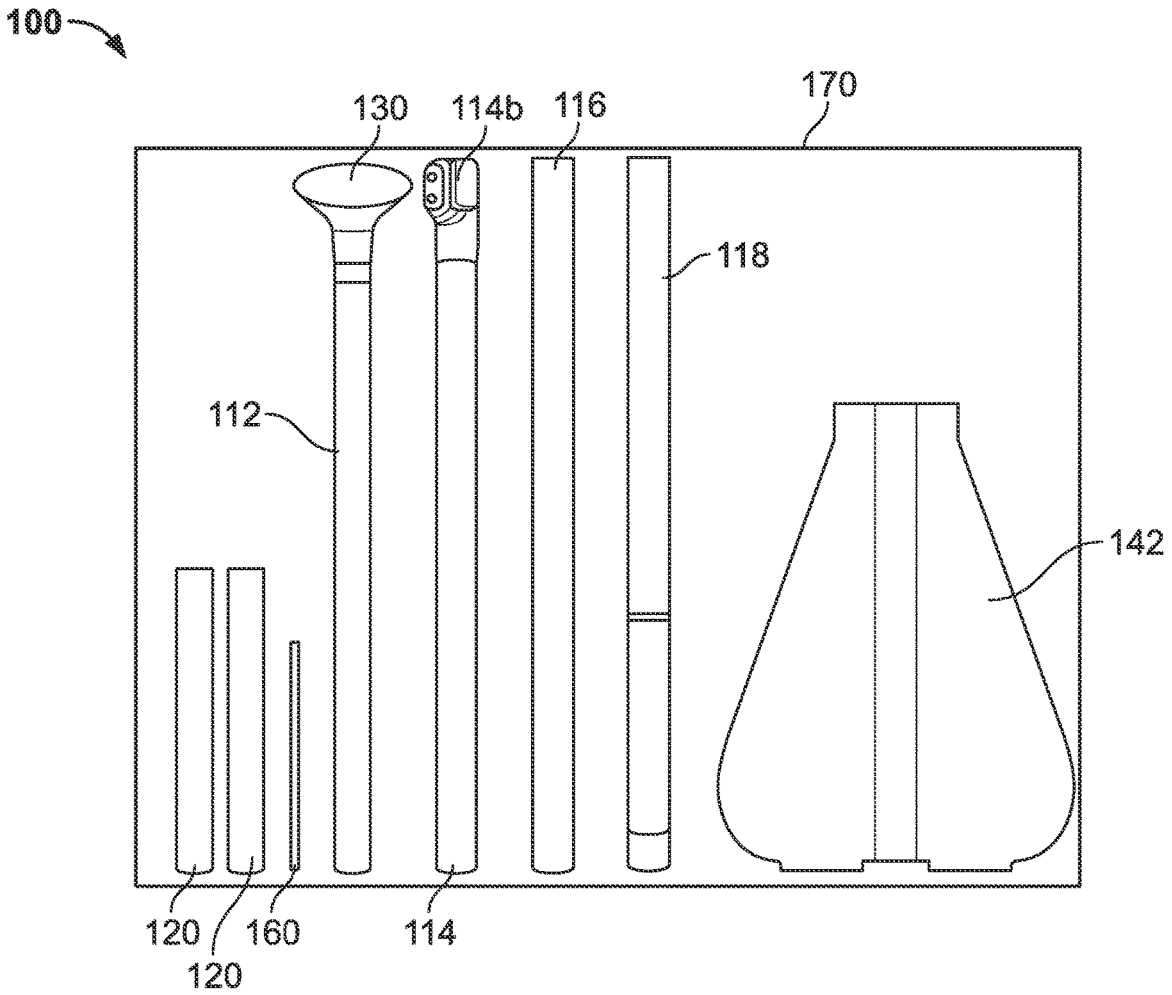
FIG. 10 is a schematic front view of the collapsible paddle shown in FIG. 8 in a disassembled state.
Figure 11:
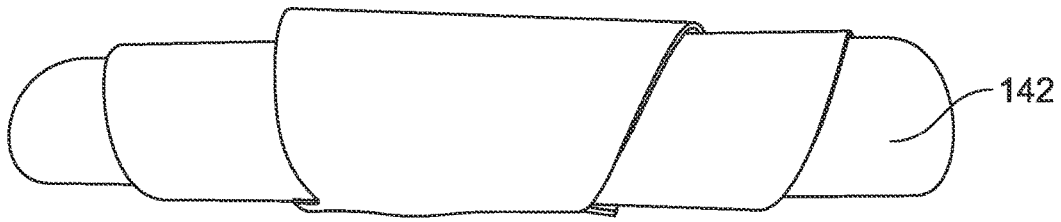
FIG. 11 is a schematic perspective view of the paddle blade of the collapsible paddle shown in FIG. 8, with the paddle blade shown in a rolled-up storage configuration.

In the example shown, the connector part 120*a* extend into each of the shaft portions 114*a*, 116*a* and into each of the shaft portions 116*a*, 118*a* a first length. This type of arrangement ensures that the assembled shaft will have sufficient strength for paddling without undue bending or failure of the assembled shaft at the connection points. Furthermore, this type of arrangement minimizes the necessary length of the shaft parts 114, 116, 118 so that the overall length of the disassembled paddle is minimized. The disclosed arrangement is also advantageous in that the collapsible paddle 100 can be assembled to have different lengths. For example, and as most easily seen at FIG. 9, the collapsible paddle 100 can be provided with all four shaft parts 112, 114, 116, 118 such that a paddle 100 having an overall length L1 is provided, wherein the length L1 can be further adjusted by sliding the shaft part 112 relative to the shaft part 114. With reference to FIG. 10, the collapsible paddle 100 is assembled without the use of shaft part 116 such that shaft parts 114 and 118 are connected together. Accordingly, in the arrangement shown at FIG. 10, the paddle 100 has an overall length L2 that is shorter than the length L1, wherein the length L2 can be further adjusted by sliding the shaft part 112 relative to the shaft part 114. With such an arrangement, the collapsible paddle 100 can be adjusted to have a wide range of customizable lengths. For example, the paddle 100 can be configured to have a length of between 44 inches and 78 inches. In one example, each shaft part 114, 116, 118 has a length of about 20 inches and the paddle 100 can have a length of between 64 inches and 78 inches with the use of shaft part 118 and a length of between 44 inches and 58 inches with the shaft part 118 removed. With such a wide range of available lengths, the paddle 100 can be used for paddlers of varying heights and also for different types of paddling, such as stand up paddle boarding (longer length required) and canoeing (shorter length required). Additionally, when fully disassembled, the paddle 100 shown has a storage length equal to the length of the longest shaft part 112, 114, 116, 120, as can be most easily seen at FIG. 10. In the example shown, the shaft parts 112, 114, 116, 118 have a length of about 20 inches and therefore the storage length of the disassembled paddle 100 is about 20 inches. Accordingly, the entire disassembled paddle 100 can be stored in a storage bag or carrier 170 of generally about the same length, as schematically shown at FIG. 10. By the use of the term generally about the same length, it is meant to include lengths up to about 0 to 6 inches longer than the longest individual part of the paddle, and more preferably lengths up to 0 to 2 inches longer than the longest individual part of the paddle.

Figure 8:
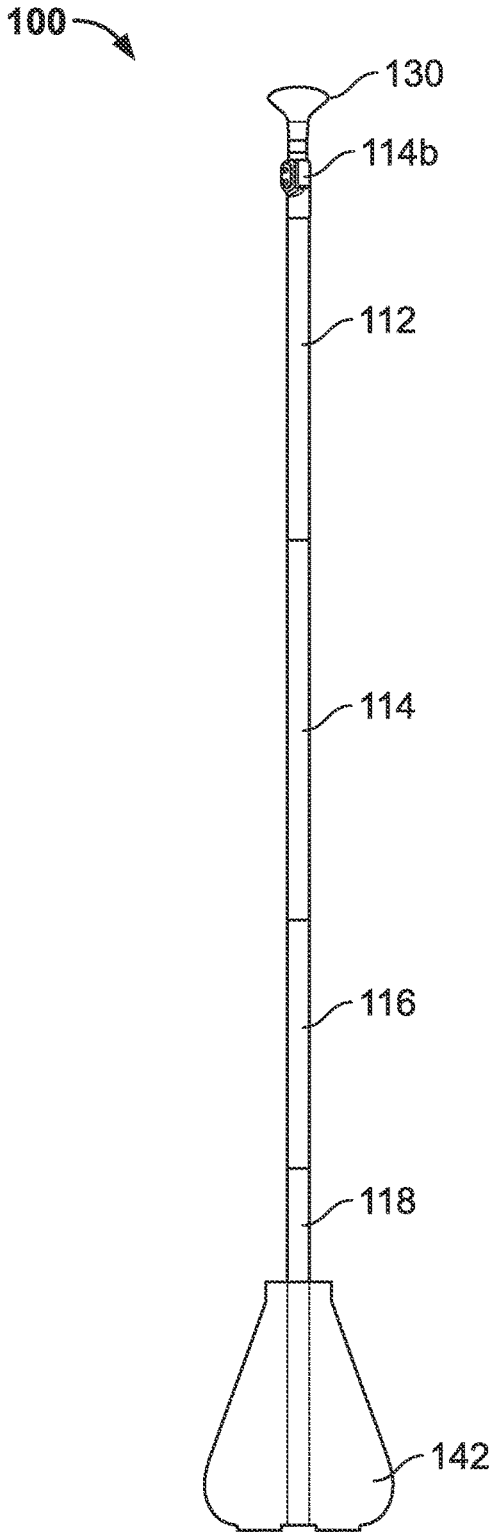
FIG. 8 is a schematic front view of the collapsible paddle shown in FIG. 1.
Figure 12:
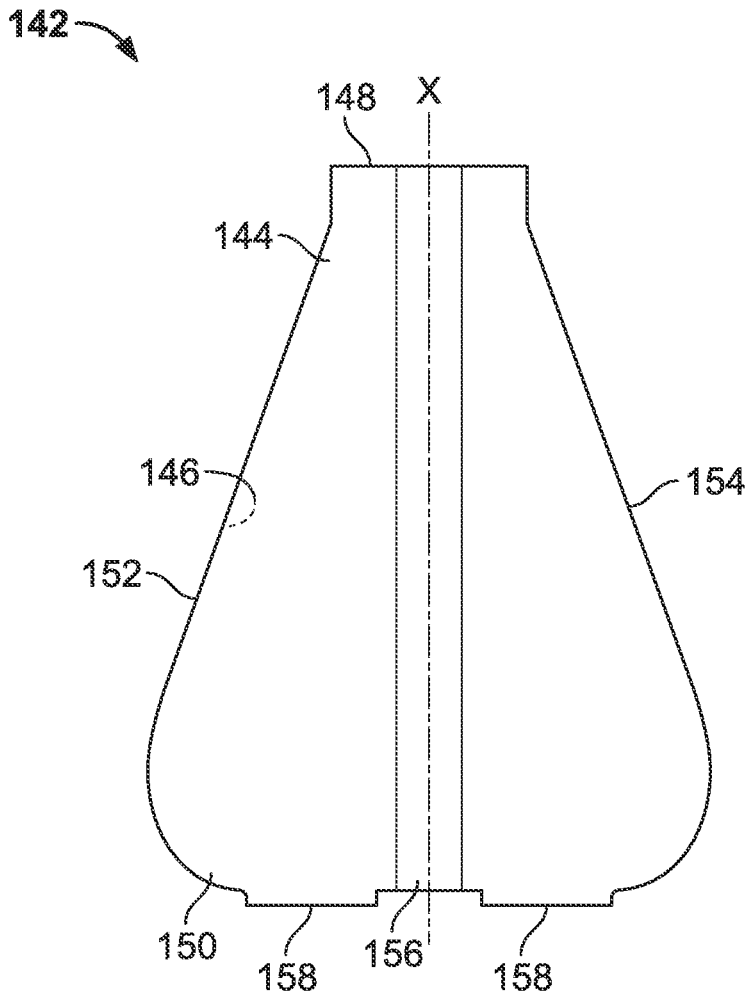
FIG. 12 is a schematic view of the blade part of the collapsible paddle shown in FIG. 8.

A further advantage of the disclosed arrangement is that the blade assembly 140 is removable from the shaft assembly 110. Yet a further advantage of the disclosed arrangement is that the blade assembly 140 is provided with a blade part 142 formed from a flexible material that allows the blade part 142 to be folded when removed from the shaft assembly. For example, FIGS. 8 and 12 show the blade part 142 in a rolled-up configuration for easy storage. In some examples, the blade part 142 can be rolled upon itself three to five times over, or more times. Accordingly, when the collapsible paddle 100 is disassembled for storage, the blade part 142 does not significantly increase the overall length or width dimensions of the stored components, as would be the case were the blade part 142 formed from a rigid material or permanently secured to the shaft assembly 110, as is traditionally the case with paddles.

For reference, the blade part 142 is shown in isolation at FIG. 12. In one aspect, the blade part 142 defines opposite main paddling surfaces 144, 146 extending between a first end 148 and a second end 150, and extending between side edges 152, 154. As configured, the blade part 142 defines a first tubular-shaped sleeve or opening 156 defined between the surfaces 144, 146 and extending between the first and second ends 148, 150 along the axis X. In one aspect, the opening 156 defines a diameter or dimension slightly larger than the shaft portion 118*a* of the shaft part 118 so that the opening 156 can slidably receive the shaft part 118. As configured, the blade part 142 further defines a pair of second tubular-shaped sleeves or openings 158 defined between the surfaces 144, 146 and extending along the second end 150 perpendicular to the axis X. As shown, the opening 156 is disposed between the openings 158 with the length of the openings 158 being orthogonal to the length of the opening 156. In one aspect, the openings 158 define a diameter or dimension slightly larger than a support pin 160 of the blade assembly 140 such that the openings 158 can slidably receive the support pin 160. As shown, the support pin 160 has a length that is the majority of a maximum width of the blade part 142. The support pin may be formed of a metal type material, such as aluminum or stainless steel, a plastic type material such as nylon, or a composite material such as carbon fiber.

Figure 2:
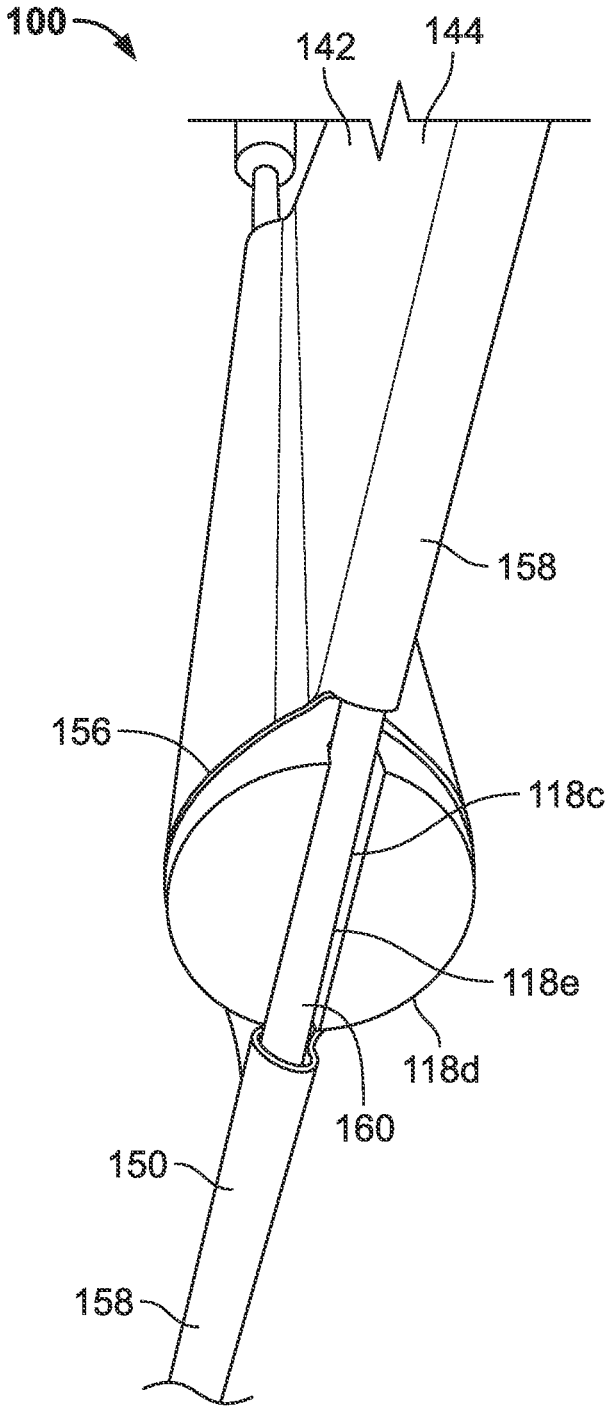
FIG. 2 is a partial end perspective view of the collapsible paddle shown in FIG. 1.
Figure 3:
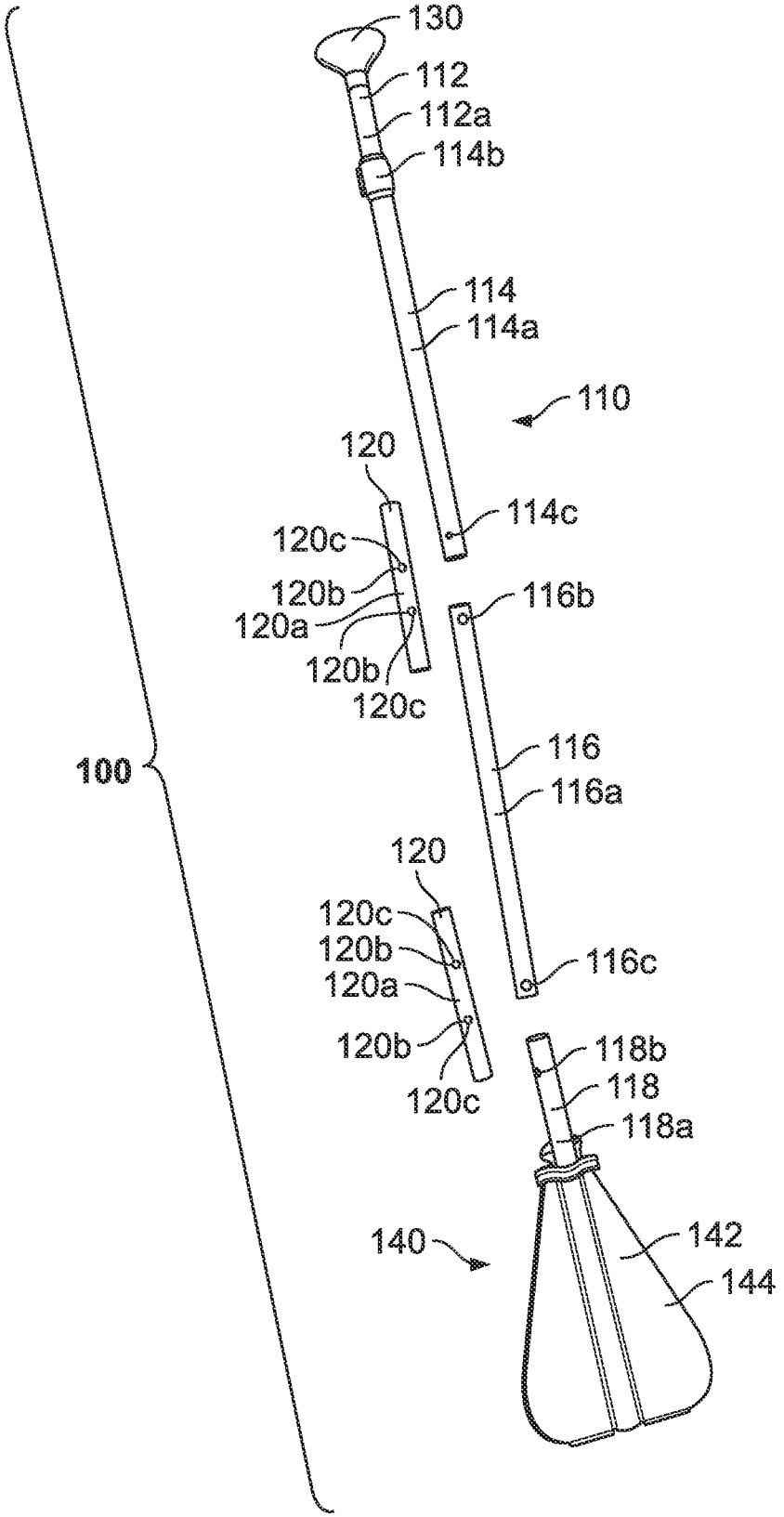
FIG. 3 is a front view of the collapsible paddle shown in FIG. 1, shown in a partially disassembled state.
Figure 4:
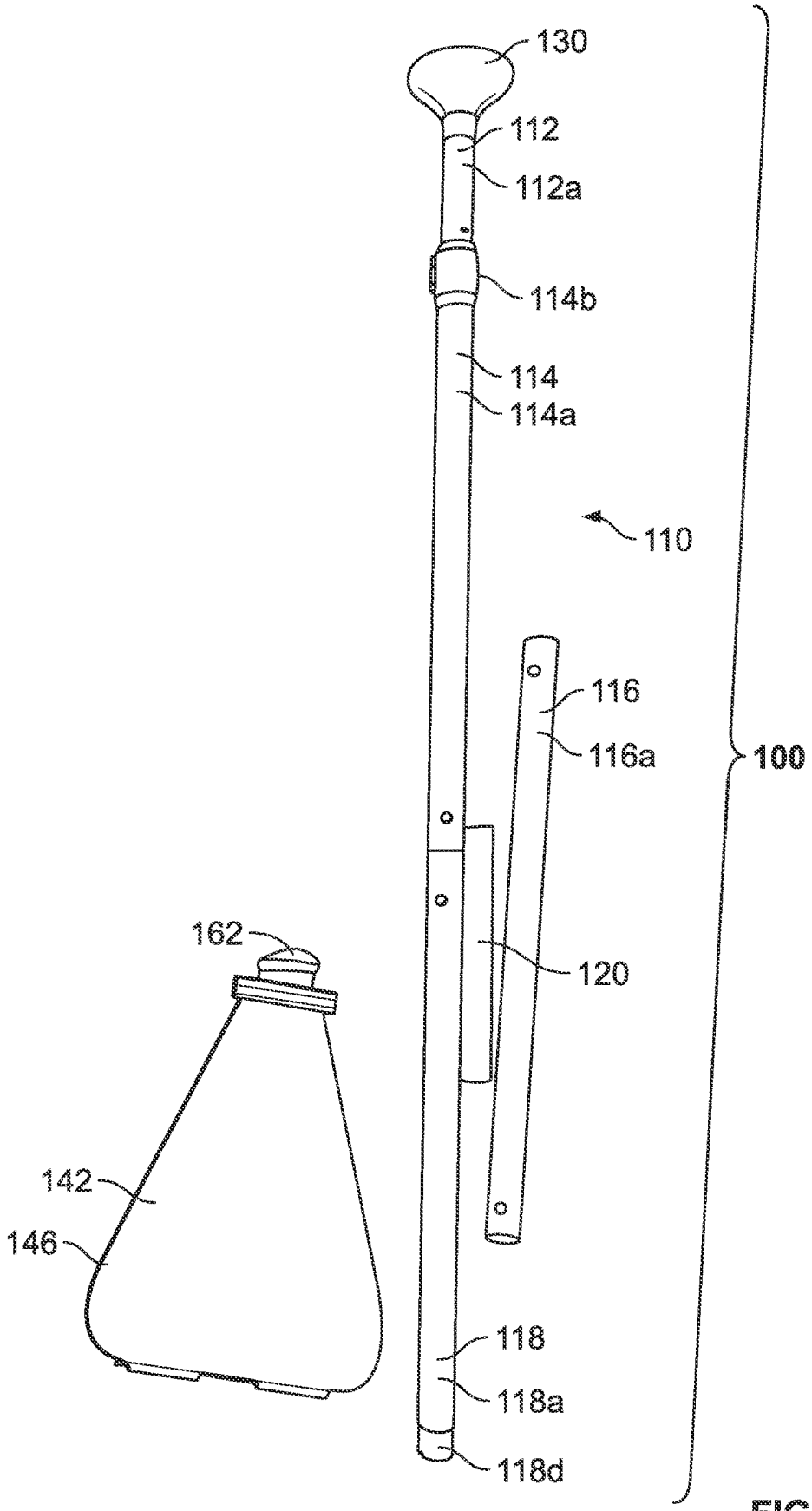
FIG. 4 is a front view of the collapsible paddle shown in FIG. 1, shown in a partially disassembled state, wherein the shaft assembly is configured without one of the shaft parts to form a shorter shaft assembly.

As most easily seen at FIG. 2, the support pin 160 is snapped into a groove 118*c* defined within a stop part 118*d* connected to the end of the shaft portion 118*a* of the shaft part 118. In one aspect, the groove 118*c* has an opening portion 118*e* with a dimension that is less than the diameter of the support pin 160 such that a snap-fit type connection results when the support pin 160 is pressed into and through the smaller sized opening and into the main portion of the groove 118*c*. The stop part 118*d* can be secured to the shaft portion 118 via adhesives and/or mechanical fasteners. In some arrangements, the stop part 118*d* could be formed integrally with the shaft part 118. In the example shown, the support pin 160 is formed from a fiberglass material and the stop part is formed from a polymeric material.

Figure 5:
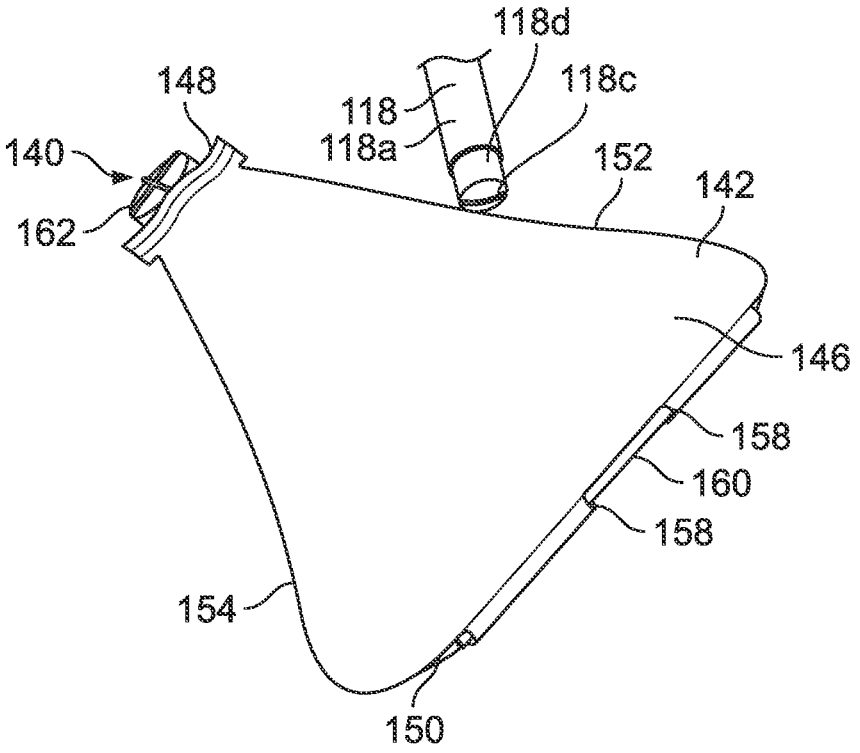
FIG. 5 is a perspective view of a paddle blade and support pin of the collapsible paddle shown in FIG. 1.
Figure 6:
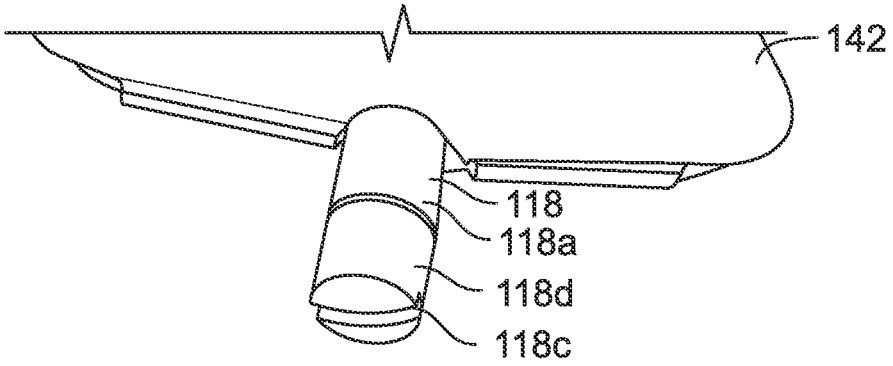
FIG. 6 is a perspective view of the collapsible paddle shown in FIG. 1, with the support pin removed from the paddle blade.
Figure 6:
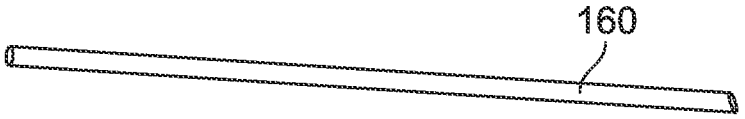
Figure 7:
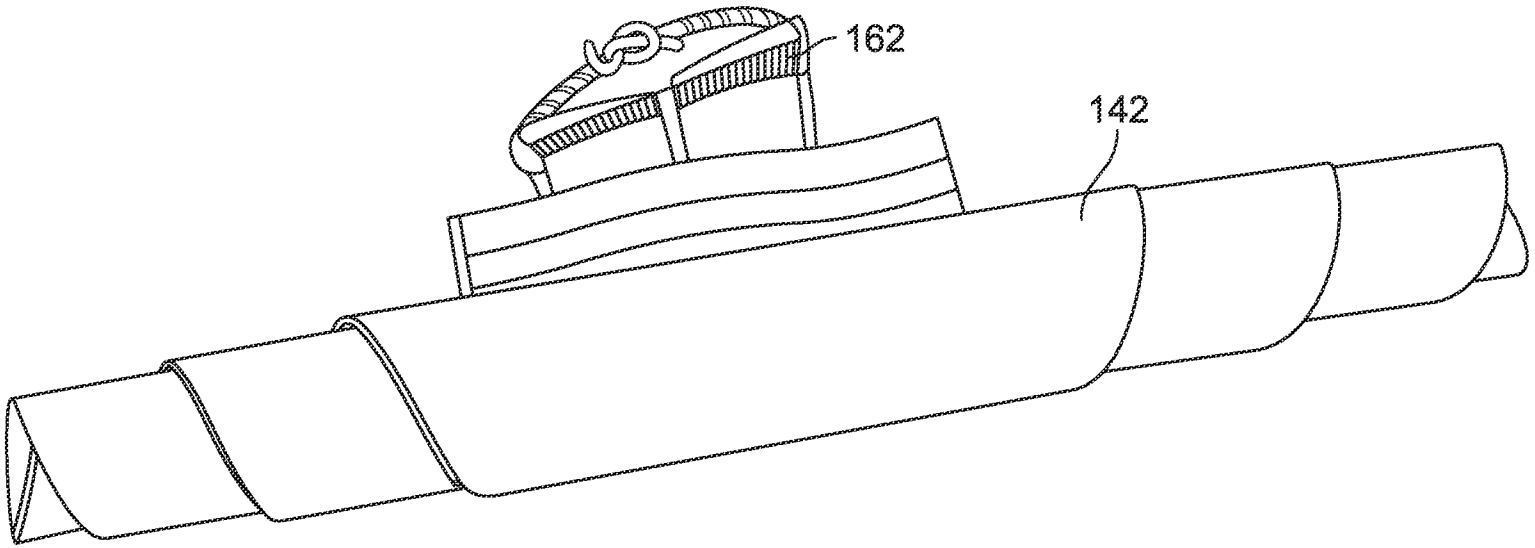
FIG. 7 is a perspective view of the paddle blade of the collapsible paddle shown in FIG. 1, with the paddle blade shown in a rolled-up storage configuration.

To assemble the blade part 142 onto the shaft part 118, the support pin 160 is first inserted through the openings 158. The blade part 142 is then slid over the shaft portion 118*a* of the shaft part 118, via the opening 156, until the support pin 160 is adjacent the groove 118*c* of the stop part 118*d*. As most easily seen at FIG. 5, a handle 162 can be provided at the first end 145 of the blade part 142 to aid in pulling the blade part 142 onto the shaft part 118. At this point, the support pin 160 is snapped into the groove 118*c*, which secures the paddle assembly 140 to the shaft part 118. In an alternative arrangement, the first end of the blade assembly can be provided with an attachment feature that is secured to a corresponding attachment feature on the shaft part 118 to further secure the blade part 142 onto the shaft part 118. Once assembled, the shaft part 118 and the support pin 160 provide adequate support to the blade part 142 such that an effective paddling surface is formed.

Figure 13:
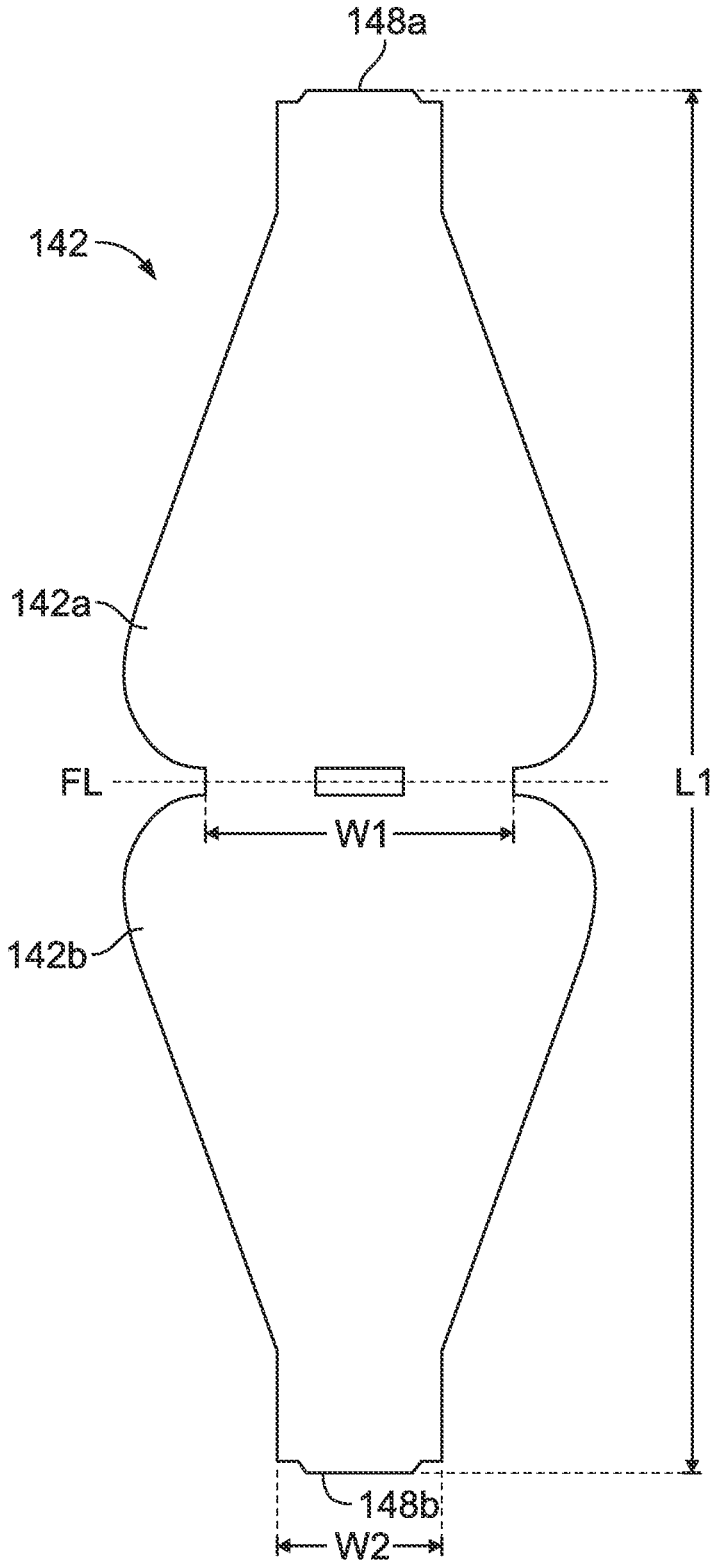
FIG. 13 is a schematic view of the blade part of the collapsible paddle shown in FIG. 12, after the blade part has been cut from a sheet and before the blade part has been formed into the final shape

Referring to FIG. 13, the blade part 142 is shown after being cut, for example die-cut, from a sheet of material, for example a flexible, foldable material such as a flexible rubber or plastic type sheet material. In the example shown, the material is a PVC material. Urethane and rubbers, such as synthetic rubbers (e.g. chlorosulfonated polyethylene synthetic rubber) are also possible materials for the blade part 142. The blade can be formed from a water impermeable material or can be formed from a water permeable material that is coated with an water impermeable material. In one aspect, the blade part 142 has an initial overall length L1, a width W1 at a fold line FL, and a width W2 proximate the first ends 148*a*, 148*b*. In one example, L1 is about 29 inches, W1 is about 6.5 inches, and W2 is about 3.5 inches. Other dimensions are possible. To fully form the blade part 142, the blade part 142 is folded about the fold line FL such that a first half 142*a* is brought against a second half 142*b*. Once folded, the portions of the blade part 142 not forming the openings 156 and 158 are joined together, for example by ultrasonic welding, heat sealing, plastic welding, stitching, and/or with an adhesive. The final length of the blade part is about half of the length L1.

Figure 14:
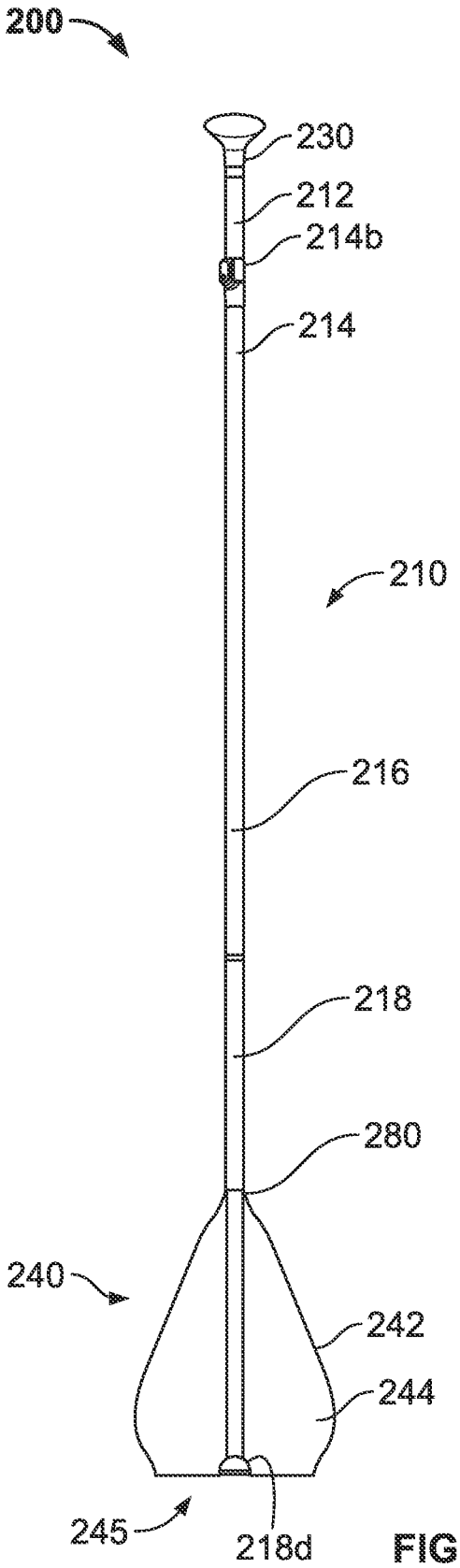
FIG. 14 is a front view of a collapsible paddle having features in accordance with the disclosure.
Figure 14A:
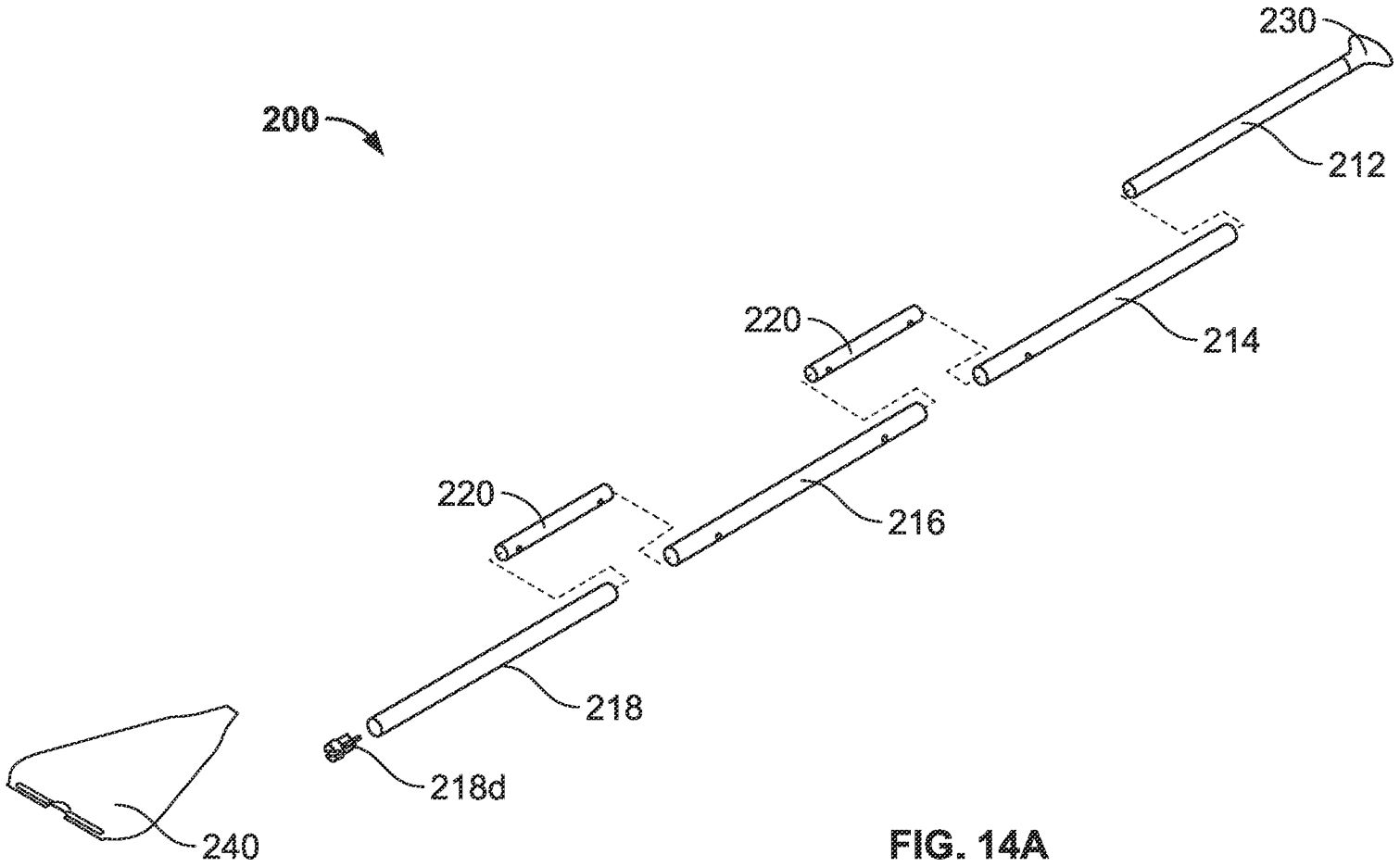
FIG. 14A is a perspective exploded schematic view of the paddle shown in FIG. 14.

Referring to FIG. 14, a second embodiment of the collapsible paddle 200 is shown in a first assembled configuration. The second embodiment has the same general structure as that of the first embodiment except in several ways outlined below. Accordingly, the above-provided description for paddle 100 is generally applicable for paddle 200. In order to avoid unnecessary repetition, a detailed description of the differences will mainly be described in order to avoid unnecessary repetition and reference numbers will be increased by 100. It is noted that the features of the paddle 100 and paddle 200 are interchangeable and may be combined in various ways. For example, the shaft, collar, blade, stop part, storage bag, and/or the support pin features of the paddle 200 may be incorporated into the paddle 100. Likewise, the shaft, blade handle, blade, stop part, storage bag, and/or the support pin features of the paddle 100 may be incorporated into paddle 200.

In one aspect, the collapsible paddle 200 includes a shaft assembly 210, a handle 230 disposed at one end of the shaft assembly 210 and a blade assembly 240 disposed at the opposite end of the shaft assembly 210.

Similar to the first embodiment of the collapsible paddle 100, the shaft assembly 210 of the collapsible paddle 200 includes four shaft parts 212, 214, 216, 218 and two intermediate connector parts (not shown). The intermediate connector parts are the same as connector parts 120, described above. The shaft assembly is additionally put together in a similar manner as previously described for the collapsible paddle 100 of the first embodiment. In an alternative arrangement, the shaft parts can be configured with tapered or reduced dimension ends, in a known manner, such that the shaft parts can be directly connected to each other without the use of intermediate connector parts.

A main difference between the collapsible paddle 200 and the collapsible paddle 100 is with the blade assembly 240. For example, the blade assembly 240 is secured to the shaft assembly 210 with a collar 280. As shown, the collar 280 is attached at a first end 245 of the blade assembly 240 such that the material of the blade assembly is clamped between the collar 280 and the shaft assembly 210. The blade assembly 240 of the second embodiment is shown in FIGS. 15 to 19. In order to more easily allow the material of the halves of the blade part 242 to surround the shaft 218 at the location of the collar 280, a halves of a top portion or area 242*a* of the blade part 242 above stitching 242*g*, discussed later, are not joined together by welding, stitching, etc.

As presented, the blade assembly 240 is provided with a blade part 242. The blade part 242 is made from a material similar to that described for blade part 142 of the first embodiment and assembled through a similar process (e.g., folding the blade part along a fold line and joining a first half with a second half using a method similar to the method described above for the blade part shown in FIG. 13). As schematically illustrated at FIG. 17A, the blade halves are joined together at a perimeter weld locations 258*f*. In one difference, the support pin 260 of blade assembly 240 is permanently retained into the blade such that installation of the support pin 260 by a user can be avoided. In the example shown, the support pin 260 is retained within the blade part 242 by joining the blade part 242 halves together proximate the ends and sides of the support pin 260, for example by stitching and/or ultrasonic welding. In the example shown, the blade part halves are sealed together proximate the ends of the support pin 260 and a stitched together along the length of the support pin 260 with stitching 242*e* going through both halves of the blade part 242 to define the opening 258 to secure the support pint 260 within the blade part 242. In one aspect, the blade part 242 includes a further opening 256 which exposes the support pin 260.

In one aspect, the blade part 242 is provided with stitching 242*c* joining the two halves of the blade part 242 together. In one aspect, the stitching 242*c* defines a passage 242*d* for receiving the shaft 218, as can be most easily seen easily in FIGS. 17 and 17*a*. The blade part halves can additionally be sealed to each other at the location of the stitching 242*c* to define the passage 242*d*. As constructed, the stitching provides additional strength to the blade part 242 at the location where the shaft 218, received into the passage 242*d*, interacts with the blade part 242. Additional stitching 242*f*, 242*g* can also be provided in each half of the blade part 242 that only extends through one half of the blade part 242. This stitching can impart additional strength to the blade part 242. Stitching 242*f* and/or 242*g* can also be used to secure a liner 242*h* within the passage 242*d*. The liner 242*h* can consist of two halves, secured by stitching 242*f*, 242*g*, such that when stitching 242*c* is applied a tubular type liner structure is created defining passage 242*d*. In some examples, thread, such as synthetic thread (e.g. polyester or nylon thread), is used for the stitching of the blade described herein. With such a construction, the shaft 218 is received by and in contact with the liner 242*h*. In one aspect, the liner 242*h* is formed from a material that has a lower coefficient of friction than the material from which the blade part 242 is formed. Such a construction is advantageous in reducing the force required to insert the shaft 218 into the blade part 242 passage in instances where significant friction exists between the blade part material and the shaft material. The reduced friction provided by the liner 242*h* also allows for the passage 242*d* dimension to be made at a tighter dimension or tolerance with respect to the diameter of the shaft 218, which results in a better fitting and higher performing product. In some examples, the liner 242*h* is formed from a woven or non-woven material, synthetic or natural material, and/or a cloth or fabric type material. In some examples, the liner 242*h* is formed from a water non-absorbent material. In some examples, the material is a polyester material, such as a polyester fabric material. In some examples, the liner 242*h* is provided with surface texturing features to reduce the contact surface area between the shaft 218 and the liner 242*h* such that a lower friction result is obtained. In some examples, the liner 242*h* is a low-friction coating applied to the back side of one or both halves of the blade part 242. In some examples, the blade part 242 material is a double-sided type material in which the exterior side that functions as the paddling surface is a plastic type material and the interior side is a material surface that has a lower coefficient in comparison to the exterior side. In some examples, the liner 242*h* is held in place or secured to the blade part 242 by an adhesive instead of or in addition to stitching.

Figure 17:
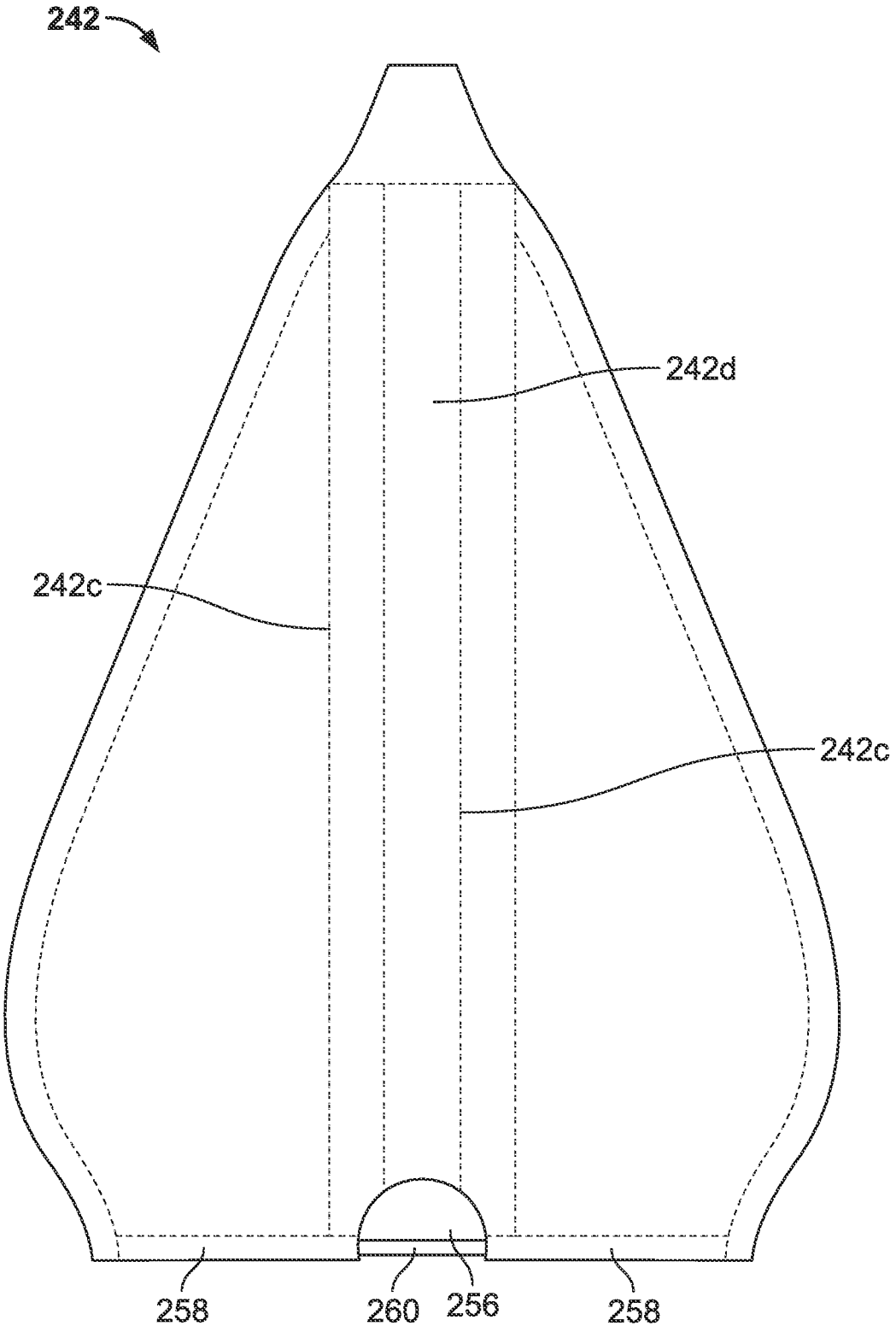
FIG. 17 is a front view of a blade assembly of the collapsible paddle of FIG. 14.
Figure 17A:
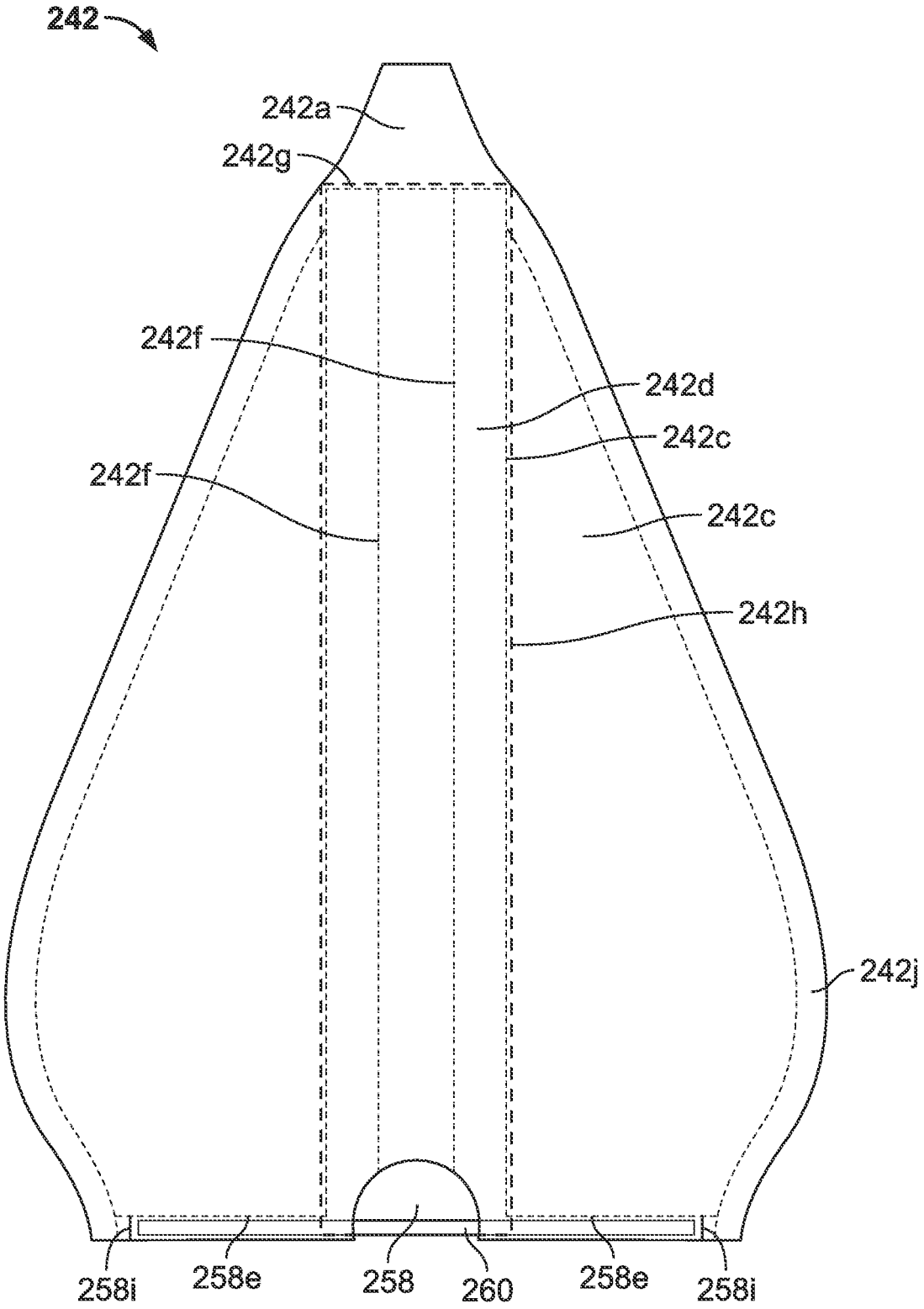
FIG. 17A is a schematic front view of the blade assembly shown in FIG. 17 showing an internal liner of the blade assembly.
Figure 17B:
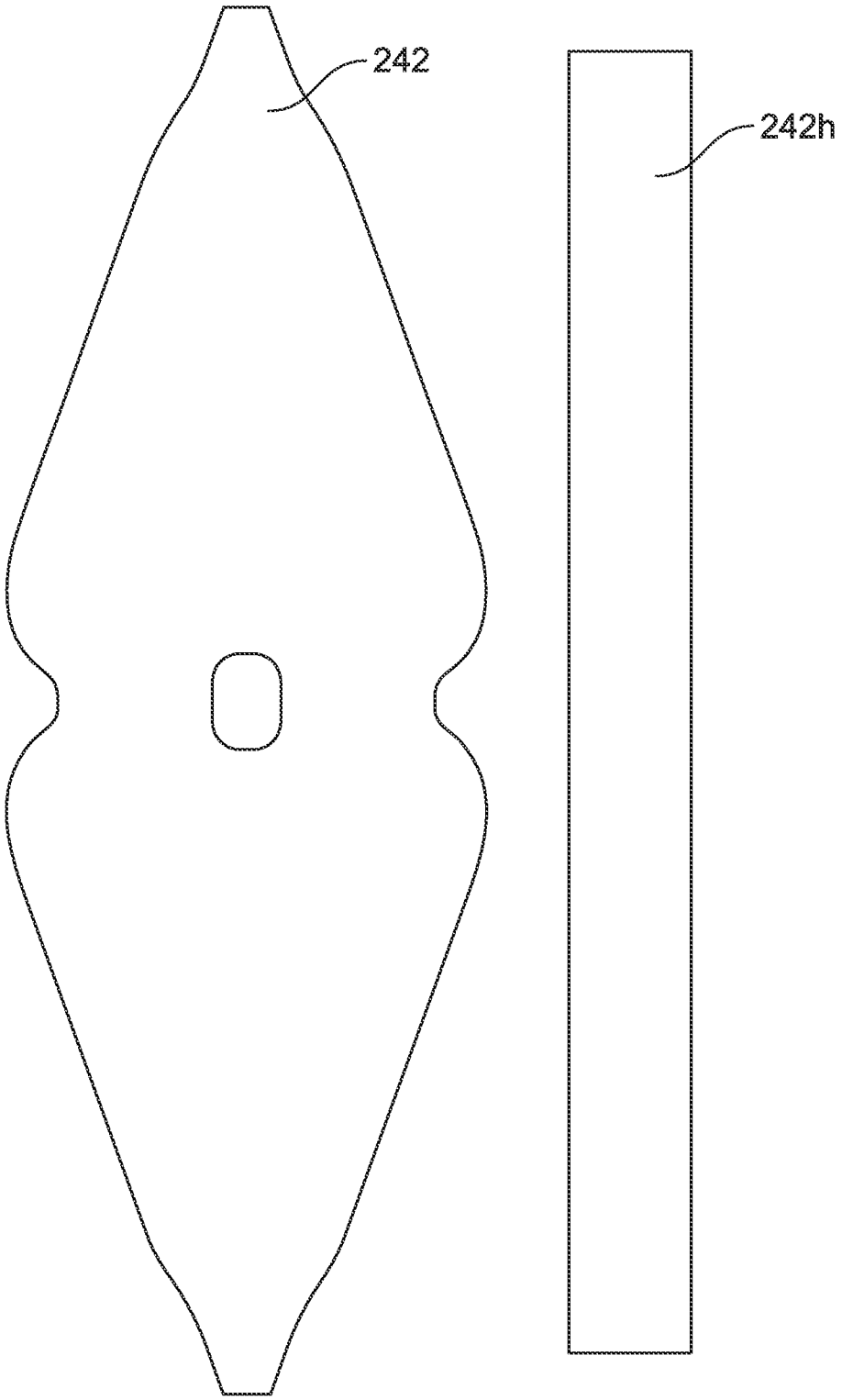
FIG. 17B is a schematic front view of the blade part and liner of the blade assembly shown in FIG. 17A, wherein the blade part and liner are in an unfolded state.
Figure 17C:
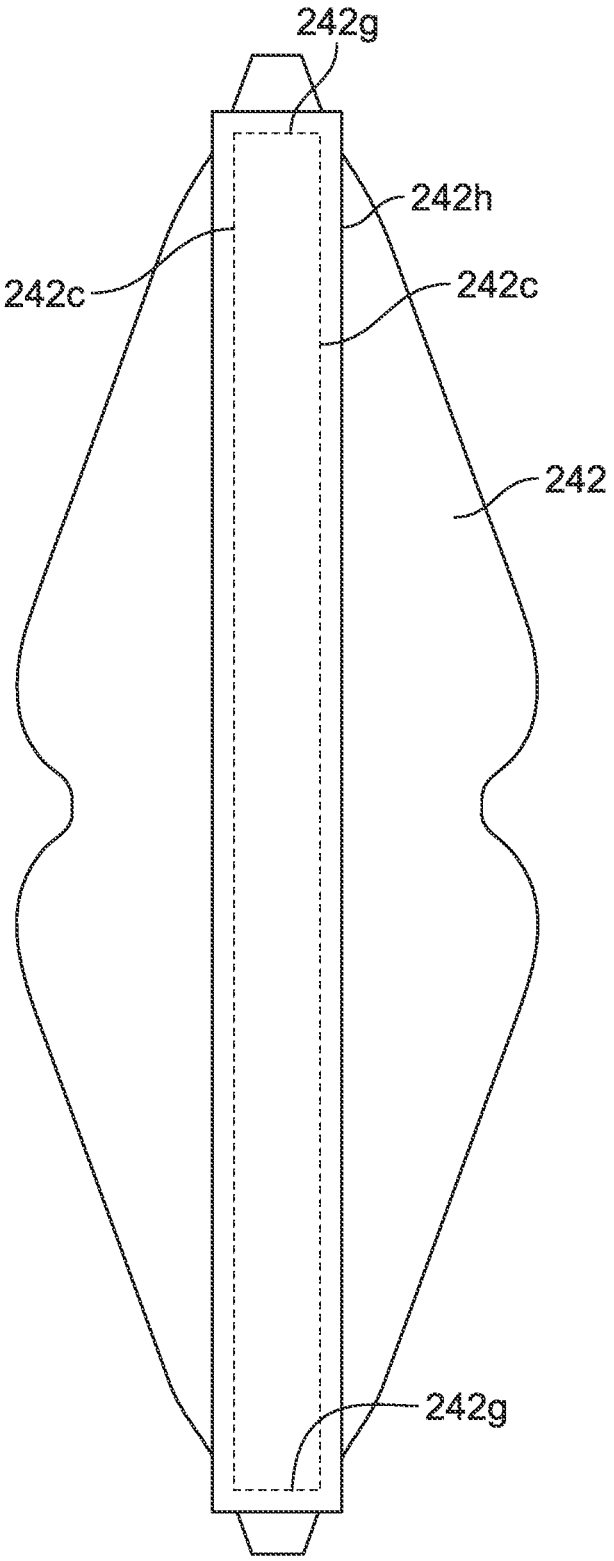
FIG. 17C is a schematic front view of the blade part and liner shown in FIG. 17B with the liner stitched to the blade part.

Referring to FIGS. 17A-17C, figures are presented showing an exemplary assembly process for the blade assembly 240 that enable the blade assembly to be formed as shown in FIGS. 17 and 17A. FIG. 17B shows an unfolded blade part 242 and the liner 242*h* are shown separately. As shown, the liner 242*h* is a rectangular shaped material that is foldable and flexible. As stated above, the liner can be a woven or nonwoven fabric-type material. As shown at FIG. 17C, the liner 242*h* is placed onto the blade part 242 such that their longitudinal axes are aligned, and the liner 242*h* is then sewn to the unfolded blade part 242 with stitch lines, for example stitch lines 242*c*, 242*g*. In one example, the liner 242*h* is temporarily secured to the blade part 242 to secure the liner 242*h* during stitching. In some examples, as stated previously, the liner 242*h* is alternatively or additionally secured to the blade part 242 by other means, such as an adhesive. After the liner 242*h* is secured to the blade part 242, the blade part can be folded in half, as is shown at FIGS. 17 and 17A. After folding, the excess material of the liner that extends beyond the shape of the blade part 242*h*, such as near the area 242*a* or at the opening 258 can be trimmed away, for example by die cutting and/or by using shears. Alternatively, the liner 242*h* can be precut to the final shape prior to attachment to the blade part 242. Once the blade part 242 and liner 242*h* are folded, stitch lines 242*c* can be provided to secure the two halves together to form the passage 242*d*. Although stitch lines 242*f* and 242*c* are shown as being separated, the stich lines can be essentially placed on top of each other, if desired. For example, stitch lines 242*c* could be provided at the location shown for stich lines 242*f*. At this stage, the stitch lines 258*e* can also be provided which further secures the blade part halves together and defines the passageway for the support pin. Once this stitching is complete, the blade part halves can be secured together, for example by ultrasonic welding or with an adhesive, such as vinyl cement. As shown at FIG. 17A, the blade part halves can be secured by such means at an attachment area 258*j* extending along the outer edges of the blade part 242. The attachment area can extend entirely between the outer edges of the blade part 242 to the stitching 242*c*, or only partially as shown. In another step, the support pin 260 is inserted into the passage defined by stitching 258*e*, and additional stitching 258*i* is provided along the ends of the support pin 260 to secure the support pin within the blade part 242. In some examples, the blade part 242 is trimmed after the aforementioned steps have been accomplished to define the final shape of the blade part 242. In some examples, additional stitching can be provided around the perimeter edge of the blade part 242 in addition to or as an alternative to providing welding or an adhesive to join the blade part halves together.

Figure 15:
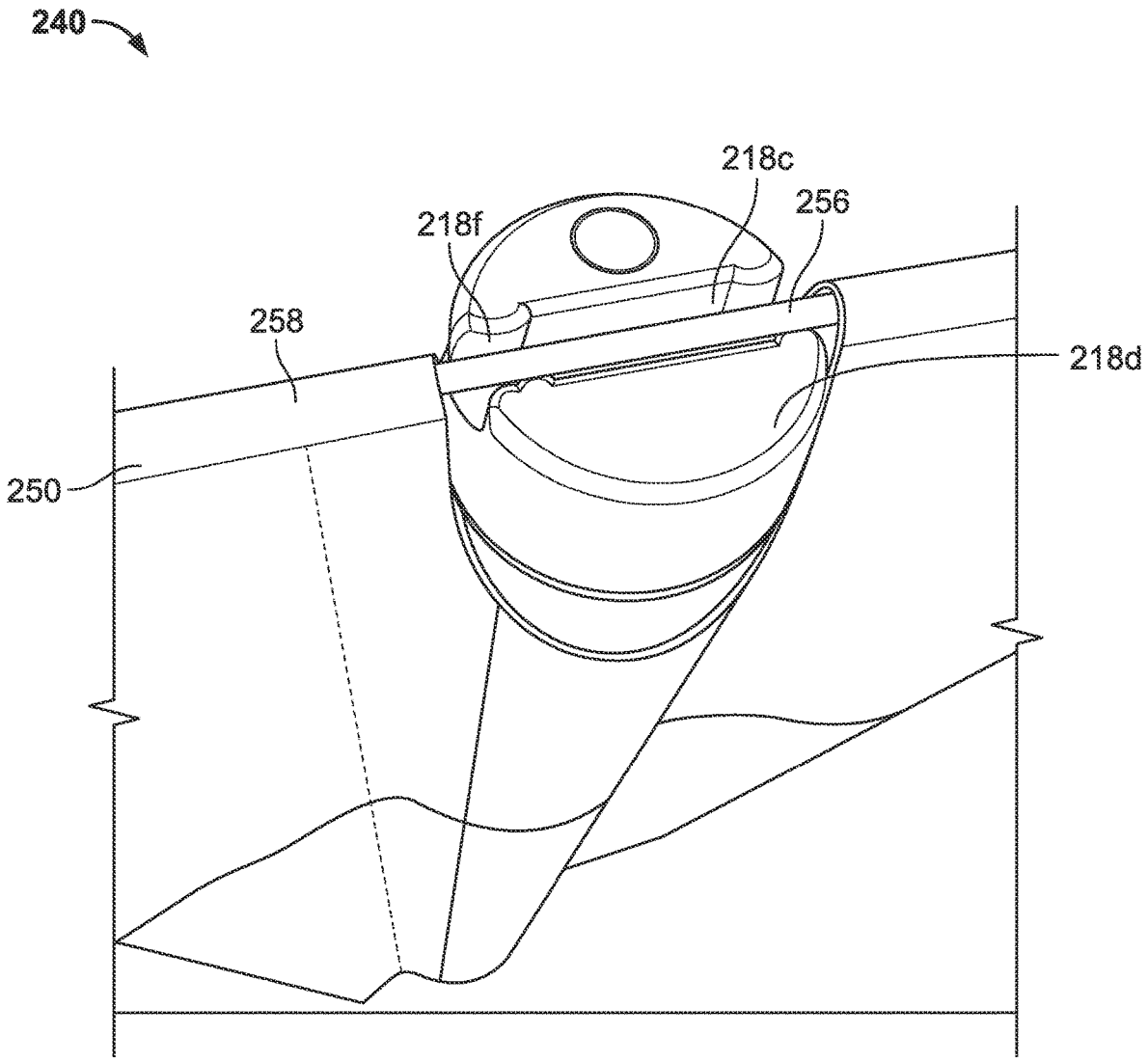
FIG. 15 is a partial end perspective view of the collapsible paddle shown in FIG. 14.

Referring to FIG. 15, the shaft portion 218 has been slid into the passage 242*d* and the support pin 260 is positioned within a groove 218*c* of a stop part 218*d*. The stop part 218*d* can include teeth or projections 218*f* extending into the groove 218*c* to effectuate a snap-fit type connection between the support pin 260 and the groove 218*c* whereby the support pin 260 is fit beneath the projections 218*f*, and can be pushed or pulled beneath the teeth 218*f* as a user assembles the collapsible paddle 200. In one aspect, the opening 256 is sized to allow the stop part 218*d* to mate with the support pin 260. Referring to FIGS. 21 to 24, a stop part 318 is presented which is usable as the stop part 118*d* and 218*d*. As shown, the stop part 318 is provided with a main body 318*a* defining an end portion 318*b* within which a groove 318*c* for receiving the support pin is defined. As shown, the end portion 318*b* is provided with a tapered or frustoconical cross-sectional shape. The main body 318*a* is further provided with a longitudinal pin or extension 318*d* which can be used to initially guide the stop part 318 into the end opening of the shaft 118, 218. The main body 318*a* is further provided with radially extending legs 318*e* located between the extension 318*d* and the end portion 318*b*. The legs 318*e* extend to a dimension equal to or slightly larger than the interior diameter of the shaft 118, 218 such that a friction type fit is accomplished between the stop part 318 and the shaft 118, 218. In some applications, a sealant or mechanical fastener can be used to alternatively or additionally secure the stop part 318 to the shaft 118, 120. In such an instance, the legs 318*e* could extend radially to a dimension less than the interior diameter of the shaft 118, 218, if desired. It is noted that the end portion 318*b* extends to a diameter or dimension equaling the outside diameter of the shaft 118, 218 to create a flush outer perimeter. With such a construction, a perimeter end face area 318*f* of the end portion 318*b* serves as a stop against the end of the shaft 118, 218.

Figure 16:
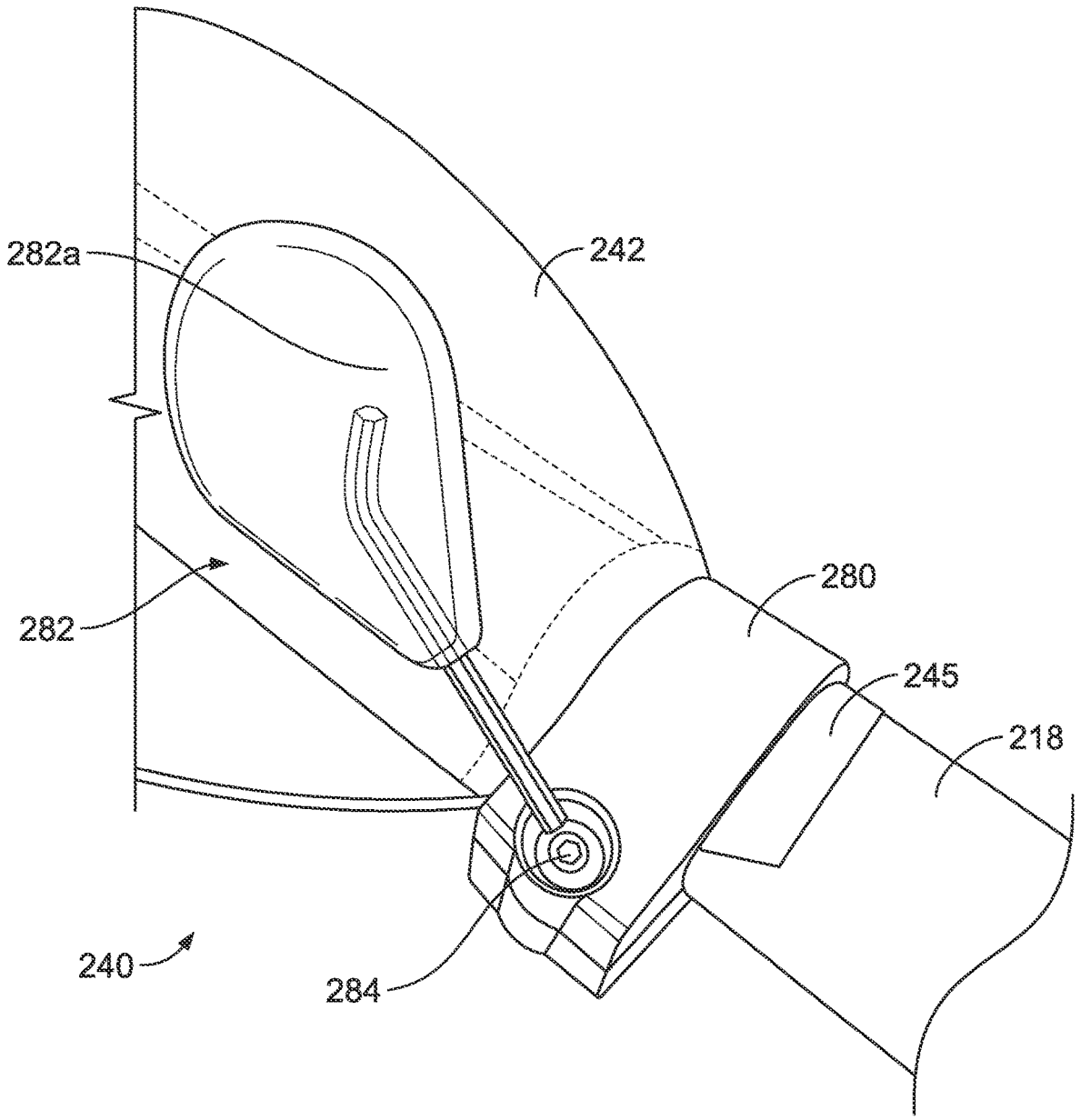
FIG. 16 is a partial perspective view of the collapsible paddle shown in FIG. 14 being assembled.

FIG. 16 shows the collar 280 being tightened to the first end 245 of the blade part 242 against the shaft 218. The collar 280 is includes a hex nut 284 which is tightened using a hex key 282. The hex key 282 includes a body 282*a* which allows the hex key 282 to be turned easily. In one aspect, the hex nut and key 282 are configured to have the same dimensions as a standard surfboard or paddleboard fin key, for example, to have a size equivalent to a 3/32 inch Allen key. The collar 280 functions similar to the handle 162 of the first embodiment discussed above in that both configurations ensure the blade part 242 is secured to the shaft such that the blade part 242 is taught or stretched between the support pin 260 and the collar or handle. Additional attachment structures can also be used.

Figure 18:
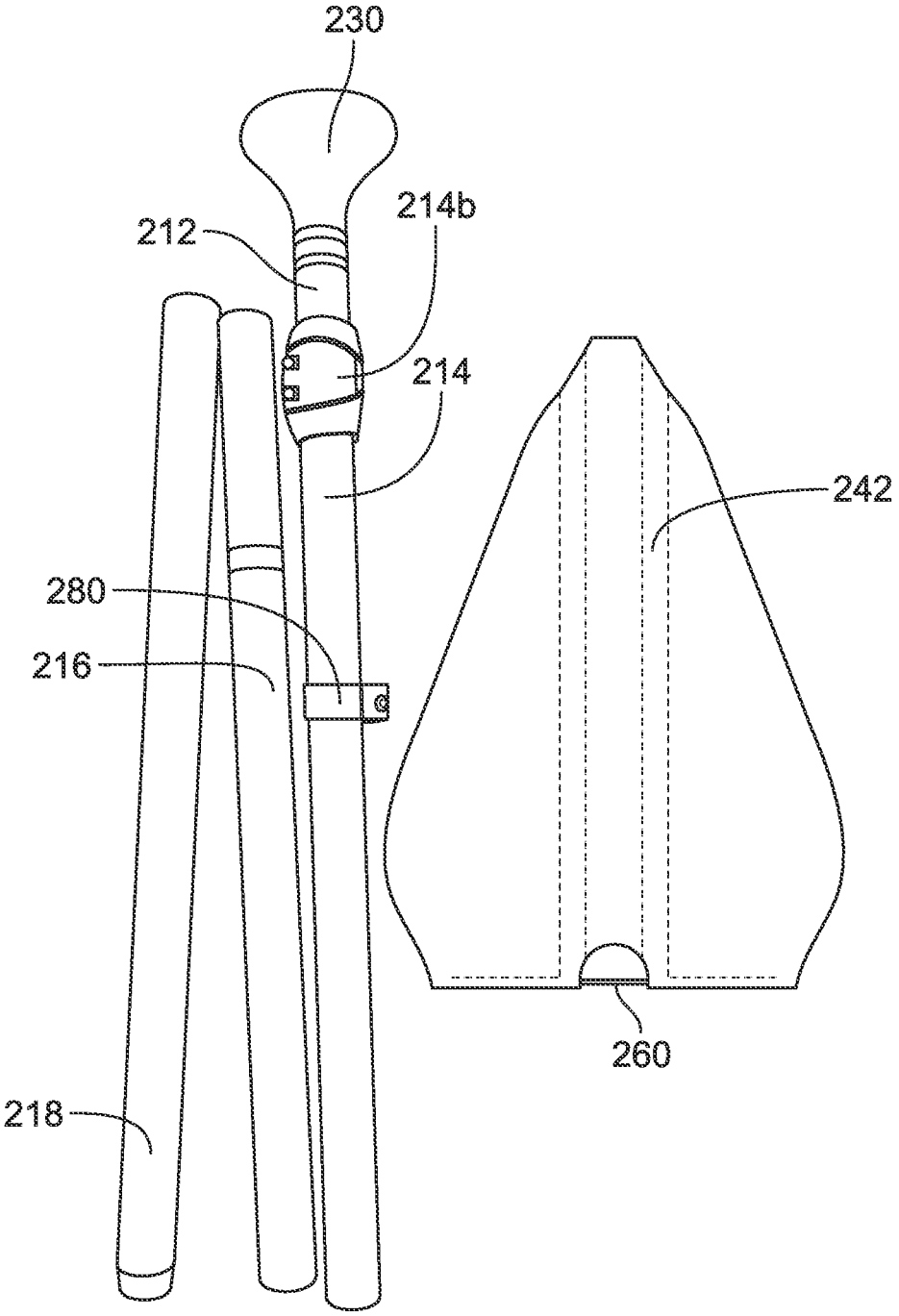
FIG. 18 is a front view of the collapsible paddle of FIG. 14 in a collapsed state.

FIG. 18 shows the collapsible paddle 200 in a collapsed state prior to being stored. The shaft parts 214 and 212 are joined by a clamp 214*b*. The connectors 220 used to join the shaft part 216 with shaft parts 218 and 214 are stored within the shaft piece 216. The connectors can also be stored within the shaft parts 218, 214. However, it is desirable for the connectors to be stored within the shaft part 216 as the shaft part 216 connects with the other shaft parts 214, 218. The blade assembly 240 is shown prior detached.

Figure 19:
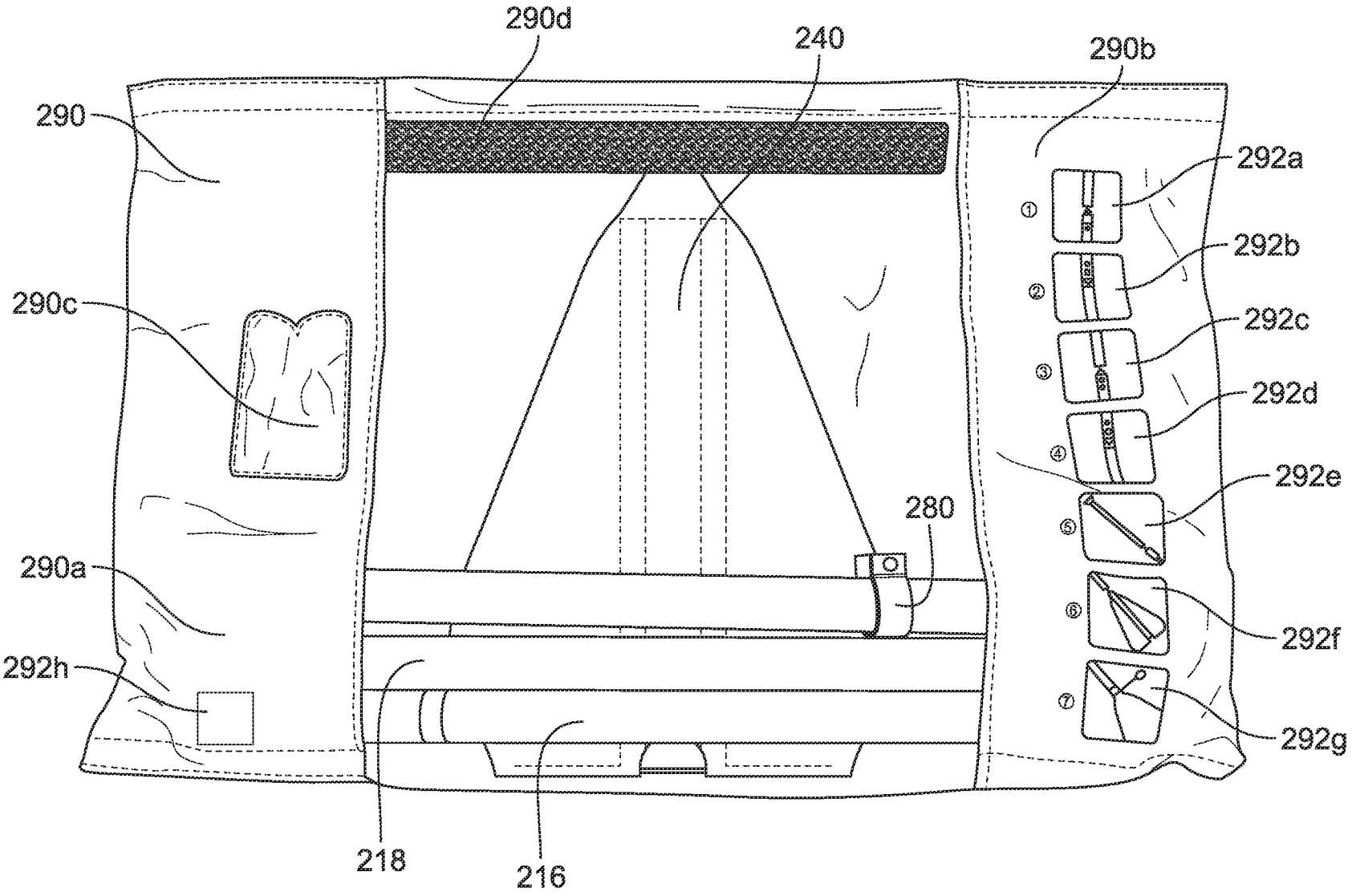
FIG. 19 is a front view of the collapsible paddle of FIG. 14 stored in a storage bag.
Figure 20:
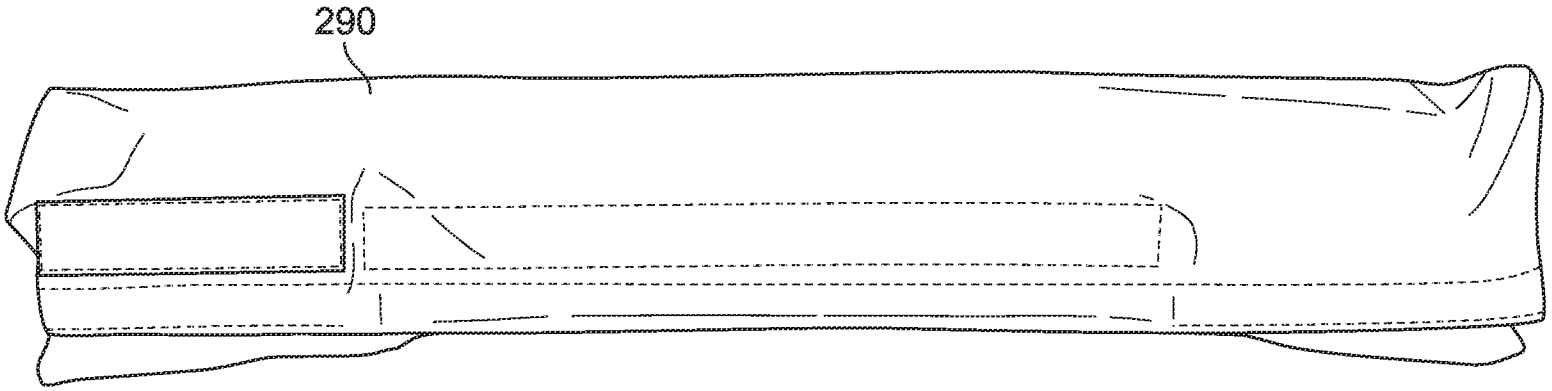
FIG. 20 is a front view of the bag of FIG. 19 rolled.
Figure 23:
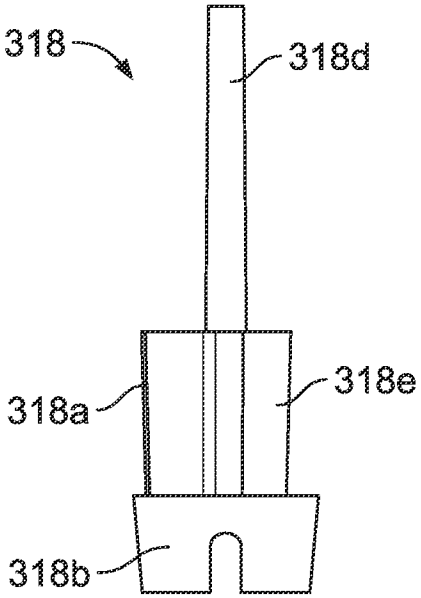
FIG. 23 is a second side view of the stop part shown in FIG. 21.
Figure 22:
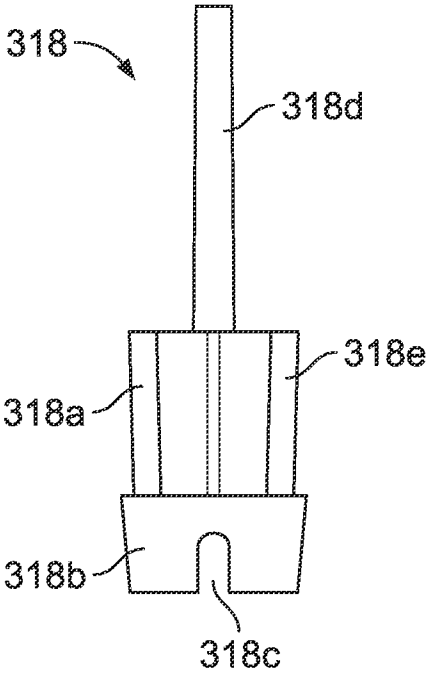
FIG. 22 is a first side view of the stop part shown in FIG. 21.
Figure 21:
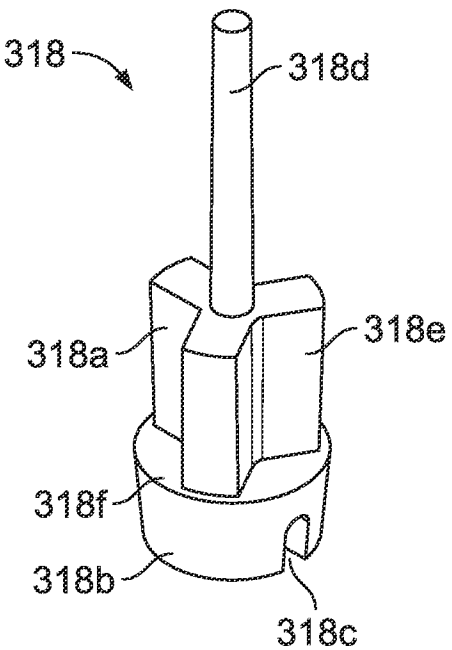
FIG. 21 is a perspective view of a stop part usable with the collapsible paddle of FIGS. 1 and 14.
Figure 24:
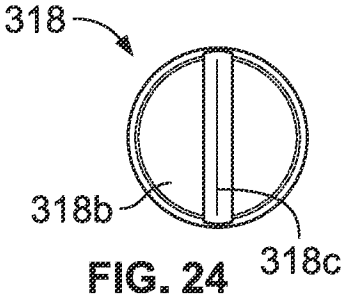
FIG. 24 is an end view of the stop part shown in FIG. 21.
Figure 25:
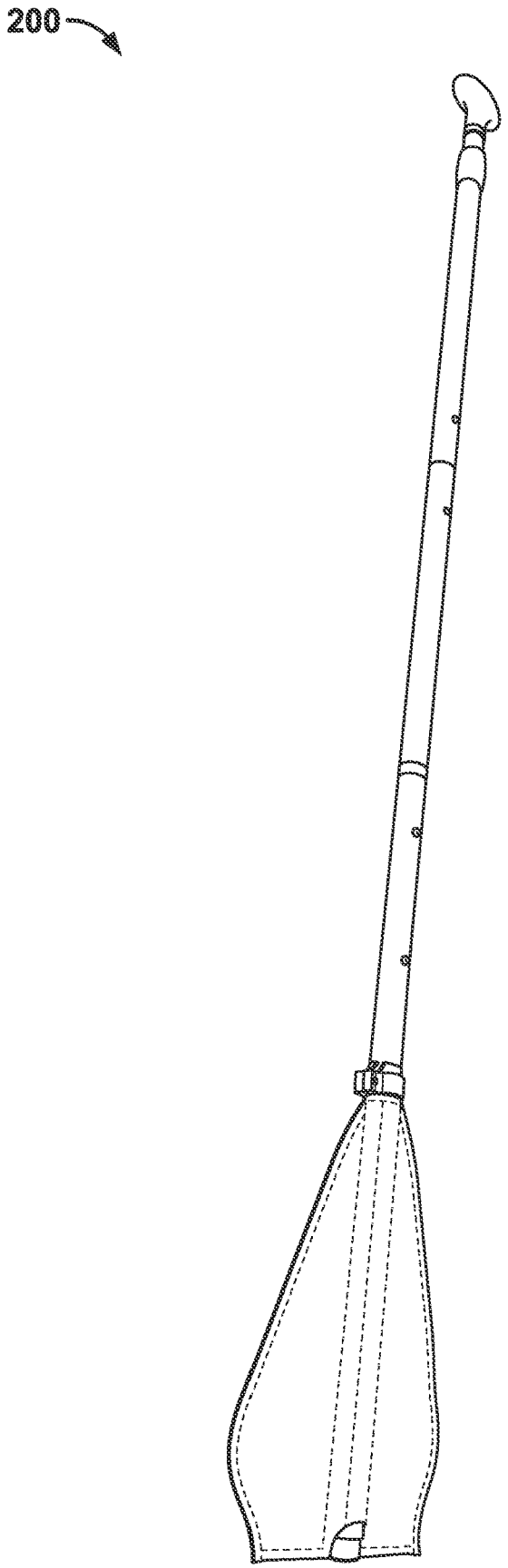
FIG. 25 is a perspective side view of the paddle shown in FIG. 14.
Figure 26:
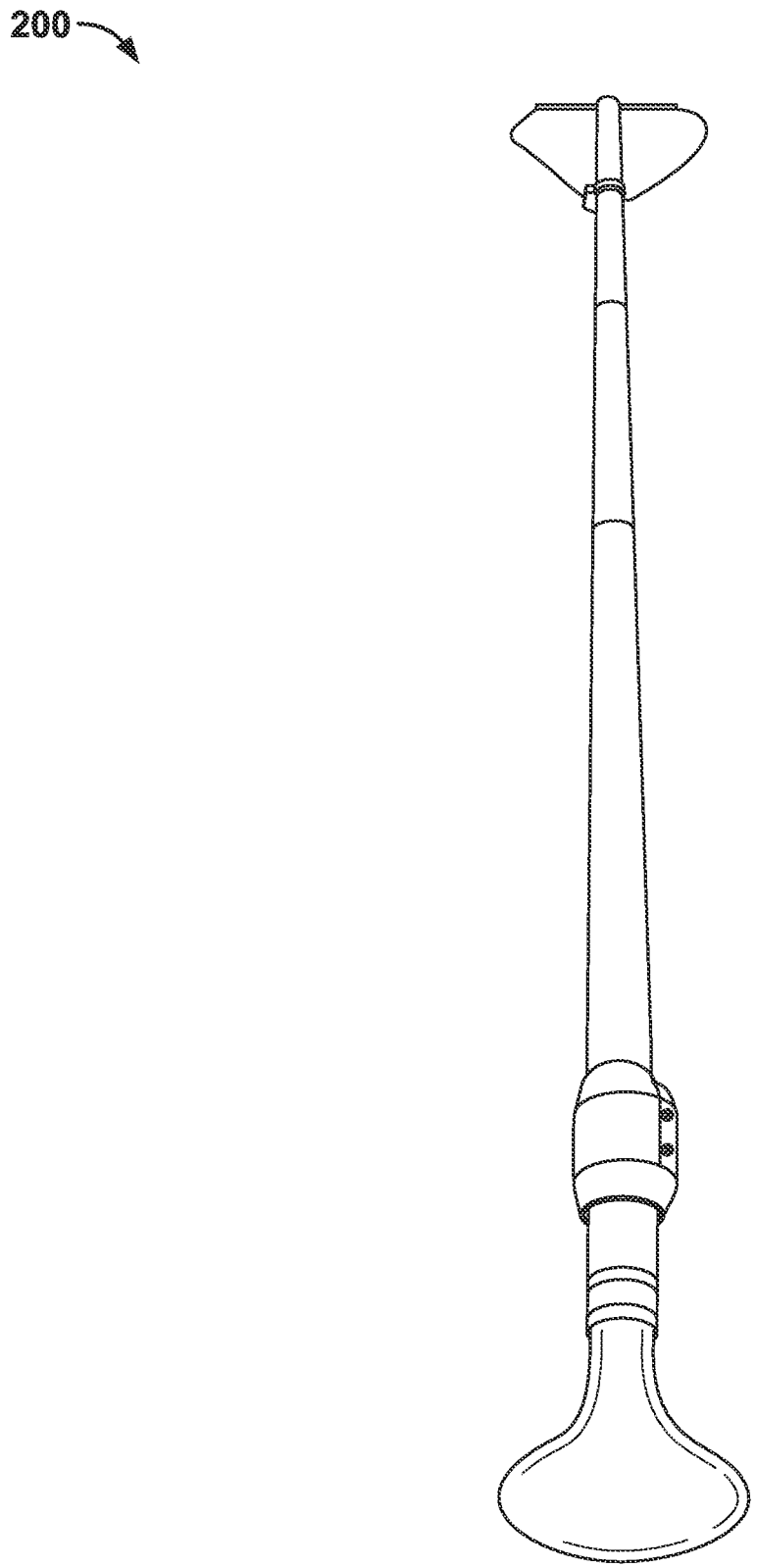
FIG. 26 is a perspective first end view of the paddle shown in FIG. 14.
Figure 27:
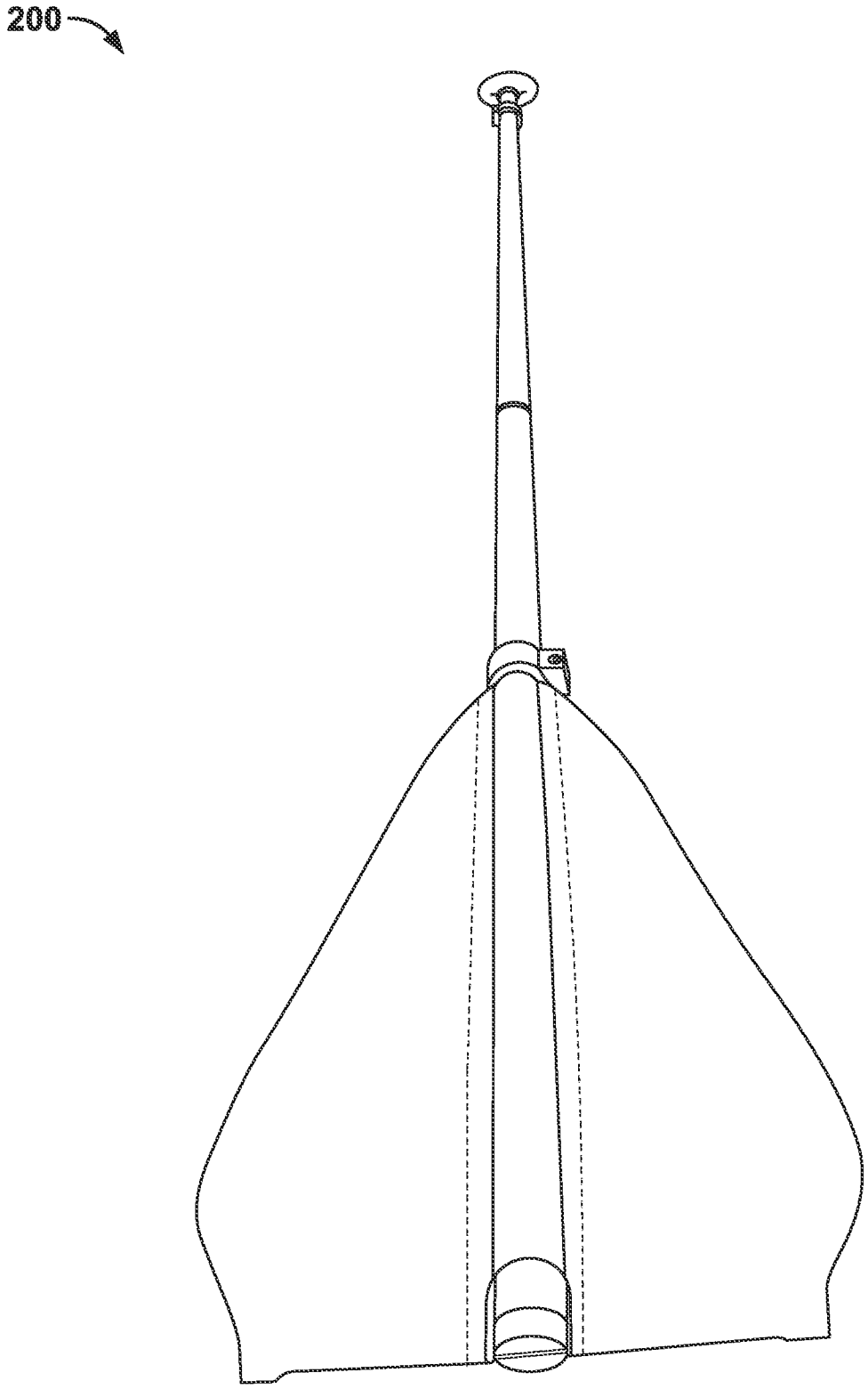
FIG. 27 is a perspective second end view of the paddle shown in FIG. 14.
Figure 28:
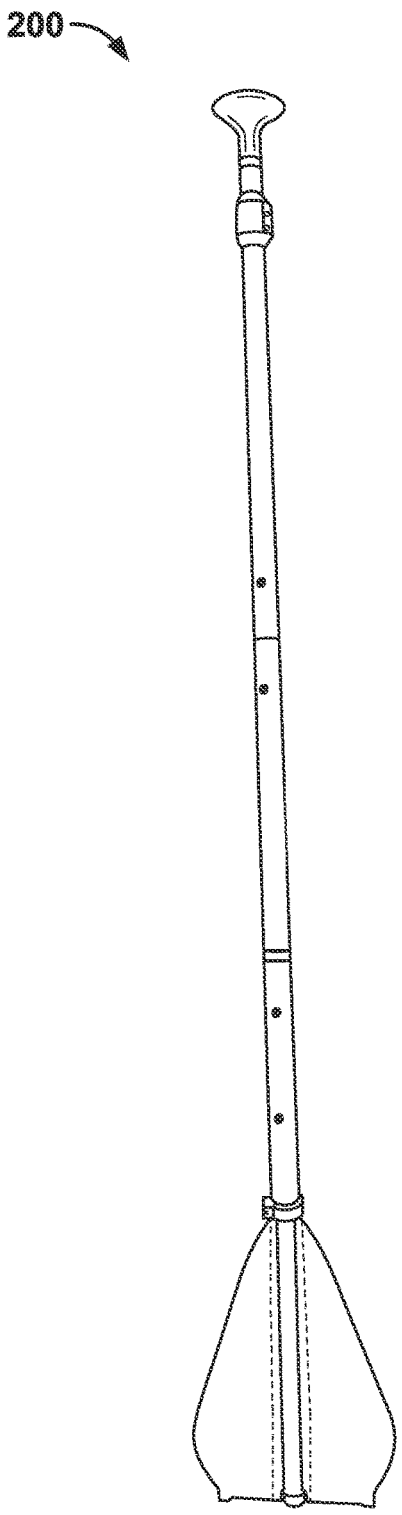
FIG. 28 is a rear view of the paddle shown in FIG. 14, the view being of an opposite side of the paddle view shown in FIG. 14.
Figure 29:
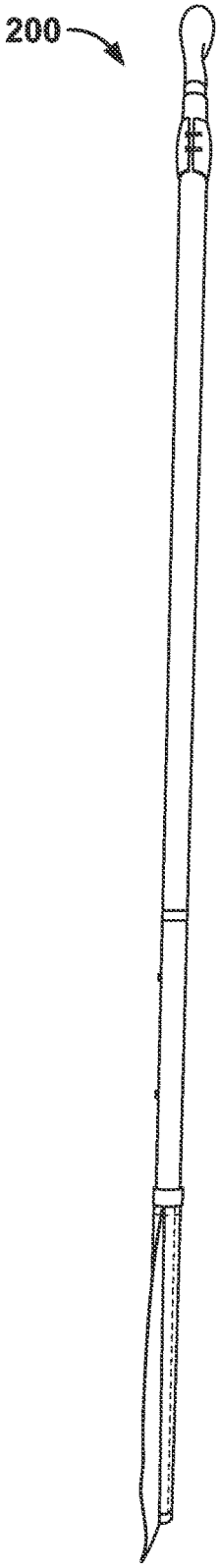
FIG. 29 is a side view of the paddle shown in FIG. 14.
Figure 30:
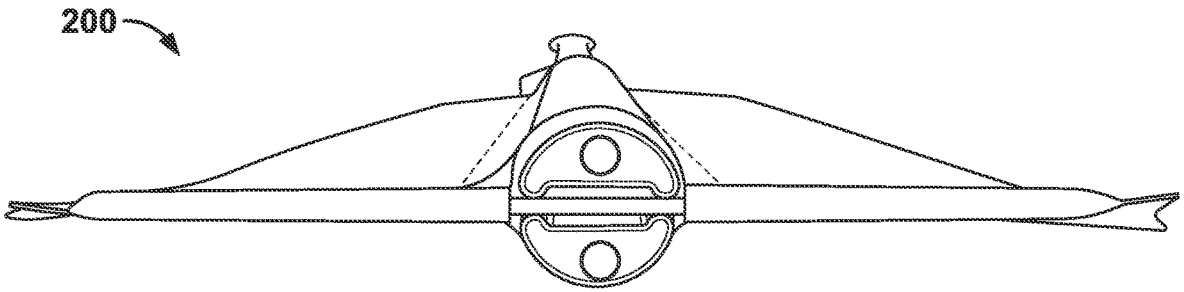
FIG. 30 is a blade-end perspective view of the paddle shown in FIG. 14.
Figure 31:
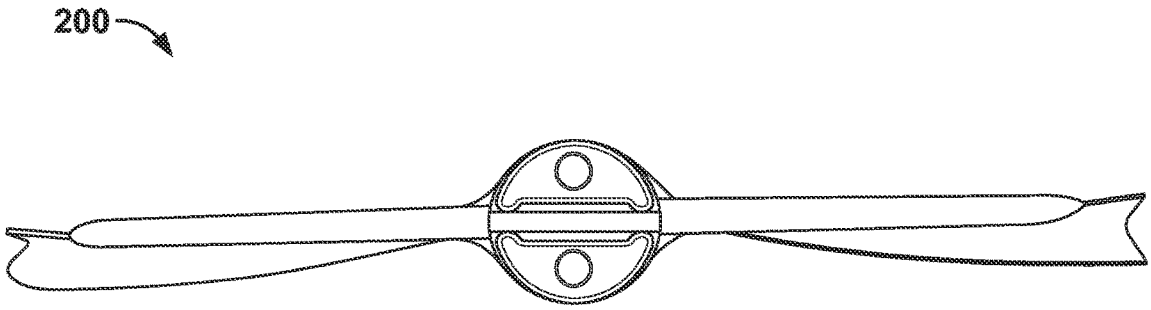
FIG. 31 is a blade-end view of the paddle shown in FIG. 14.
Figure 32:
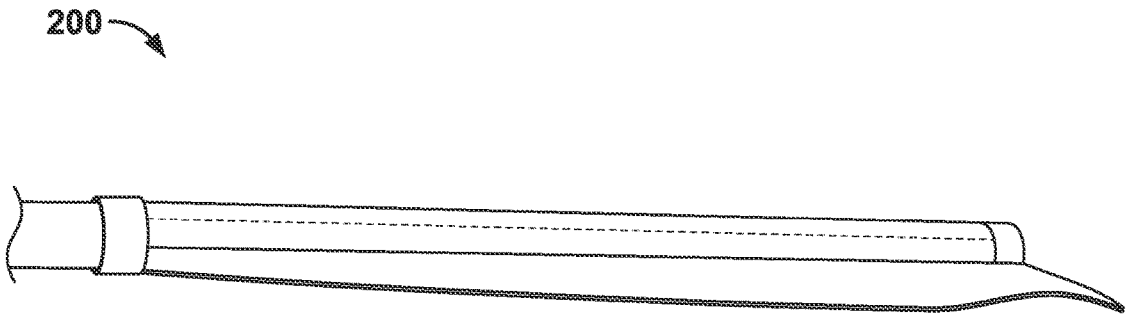
FIG. 32 is a side view of a blade portion of the paddle shown in FIG. 14.
Figure 33:
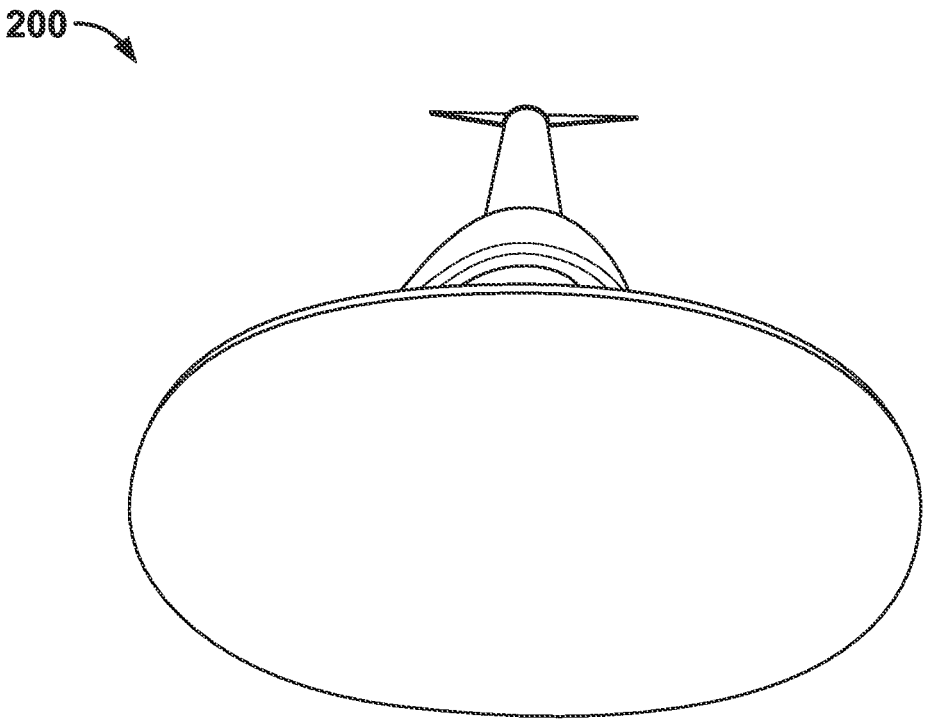
FIG. 33 is a perspective handle-end view of the paddle shown in FIG. 14.
Figure 34:
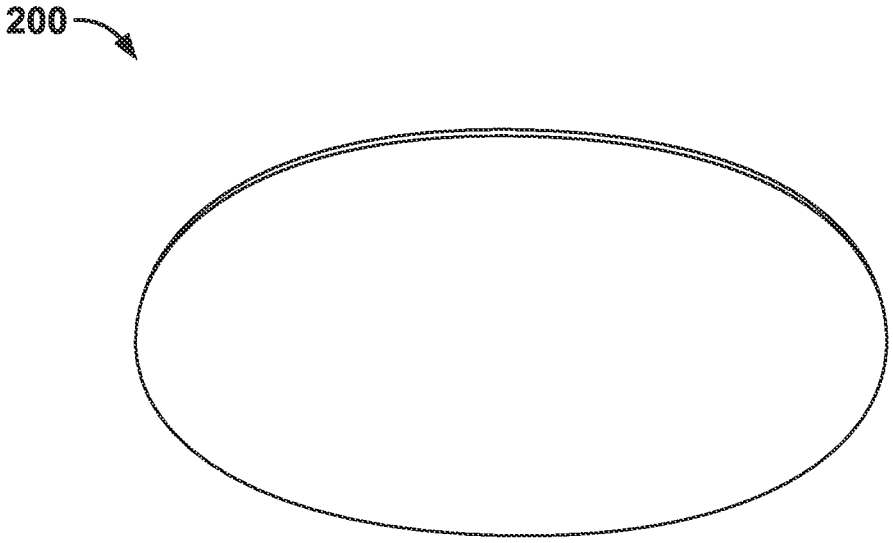
FIG. 34 is a handle-end view of the paddle shown in FIG. 14.

FIGS. 19 and 20 show the collapsible paddle 200 being stored in a storage bag 290. The storage bag 290 includes a first partially stitched side 290*a* and second partially stitched side 290*b*. The partially stitched sides 290*a*, 290*b* are folded and stitched to provide pockets at each end to receive and store the shaft pieces 212, 214, 216, 218 are all stored within. The resulting length of the bag 290 is thus about the same or slightly longer than the length of the shaft pieces, which are generally of the same length as each other. The connector pieces can be stored inside one of the shaft pieces such that a smaller and/or separate storage area is not needed for the connector pieces. The blade assembly 240 can be tucked behind the shaft pieces 212, 214, 216, 218 and between the partially stitched sides 290*a*, 290*b*. The storage bag 290 additionally includes a pouch 290*c* which cards, keys or other items can be stored within. Once the components of the paddle 200 are placed in the storage bag as shown at FIG. 19, the storage bag 290 can be rolled with all of the components stored within the storage bag 290 with the blade part 242 being folded/rolled about the shaft pieces. The storage bag 290 includes hook and loop type attachment structures 290*d*, such as Velcro, to hold the storage bag 290 together in a relatively secure manner when the storage bag 290 has been fully rolled up. FIG. 20 shows the storage bag 290 in a rolled state for easy storage.

The storage bag 290 additionally includes printed instruction indicia 292*a*-292*g* on the second partially stitched side 290*b*. One instruction 292*a* is to remove the connectors from the center piece. The connectors, as discussed above are normally store in the shaft piece 216. Another instruction 292*b* is to place one connector in the shaft piece 216. Another instruction 292*c* is to put one connector in the other side of the shaft piece 216. Another instruction 292*d* is to attach the shaft piece 214 to the shaft piece 218 using one of the connectors placed in the shaft piece 218. Another instruction 292*d* is to attach the shaft piece 218 with the shaft piece 216. Another instruction 292*f* is to attach the blade assembly 240 to the shaft piece 218 by inserting the shaft into the blade part opening until the support pin is received into the end part. The final instruction 292*g* is to tighten the collar 290 to the blade assembly 240. Further, the first partially stitched side 290*a* includes a QR code 292*h* which links to an instructional video that provides instructions for putting the paddle together.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

What is claimed is:

1. A paddle for use with watercraft, the paddle comprising:

a) a shaft assembly;

b) a handle connected to a first end of the shaft assembly; and c) a blade assembly including a flexible blade part removably connected at a second end of the shaft assembly, the blade part being foldable when removed from the shaft assembly, wherein the blade part defines opposite first and second paddling surfaces and further defines a central opening between the first and second paddling surfaces, the central opening receiving the shaft assembly, wherein the central opening is defined by stitching provided in the flexible blade part.

2. The paddle of claim 1, wherein the blade part is foldable into a rolled-up position when removed from the shaft assembly.

3. The paddle of claim 1, further including a liner within the central opening, the liner being formed from a material that is different from a material of the flexible blade part.

4. The paddle of claim 1, wherein the blade assembly further includes a support pin oriented orthogonally to the shaft assembly.

5. The paddle of claim 4, wherein the support pin is received into one or more second openings defined by the blade part.

6. The paddle of claim 4, wherein the support pin is connected to the shaft assembly.

7. The paddle of claim 4, wherein the shaft assembly includes a cap part defining a groove that removably receives the support pin.

8. The paddle of claim 1, wherein the shaft assembly includes multiple interconnected shaft parts.

9. The paddle of claim 1, wherein the handle is connected to a first shaft part and wherein the first shaft part is slideable relative to a second shaft part.

10. The paddle of claim 9, further comprising a clamp for securing the first shaft part to the second shaft part.

11. The paddle of claim 1, wherein the blade part is formed from a PVC material.

12. The paddle of claim 1, wherein the shaft assembly is formed from an aluminum or carbon fiber material.

13. A paddle for use with watercraft, the addle comprising:

a shaft assembly;

a handle connected to a first end of the shaft assembly; and a blade assembly including a flexible blade part removably connected at a second end of the shaft assembly, the blade part being foldable when removed from the shaft assembly;

wherein in the blade part is formed by folding a sheet material about a fold line.

14. The paddle of claim 13, wherein the blade part is formed by one of ultrasonic welding or adhering a first half of the blade part to a second half of the blade part.

15. The paddle of claim 8, wherein the paddle has an overall disassembled storage length equal to the length of the longest shaft part.

16. The paddle of claim 15, wherein the paddle has an overall disassembled storage length equal to about 20 inches.

17. The paddle of claim 1, wherein the paddle can be adjusted to have a length between 44 inches and 78 inches.

18. A paddle assembly comprising:

a) the paddle of claim 1; and b) a storage bag for holding the paddle in a disassembled state, the storage bag having a length of generally the same length as a longest individual part of the paddle.

19. A paddle for use with watercraft, the paddle comprising:

a) a flexible blade part defining opposite first and second paddling surfaces extending between a first end and a second end;

b) a shaft extending longitudinally through the flexible blade part between the first and second paddling surfaces and from the first end to the second end; and c) a support pin extending laterally through the flexible blade part between the first and second paddling surfaces at a location proximate the flexible blade part second end, the support pin being attached and orthogonal to an end of the shaft.

20. The paddle of claim 19, further comprising:

a) a cap part mounted to the end of the shaft and connecting the support pin to the shaft.

* * * * *